US011830667B2

(12) United States Patent
Kondo

(10) Patent No.: US 11,830,667 B2
(45) Date of Patent: Nov. 28, 2023

(54) IGNITION COIL

(71) Applicant: DENSO CORPORATION, Kariya (JP)

(72) Inventor: Yuki Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 470 days.

(21) Appl. No.: 17/000,153

(22) Filed: Aug. 21, 2020

(65) Prior Publication Data

US 2021/0057148 A1 Feb. 25, 2021

(30) Foreign Application Priority Data

Aug. 22, 2019 (JP) ..... 2019-151999

(51) Int. Cl.

| | |
|---|---|
| ***H01F 38/12*** | (2006.01) |
| ***H01F 3/12*** | (2006.01) |
| ***H01F 27/24*** | (2006.01) |
| ***H01F 27/28*** | (2006.01) |

(52) U.S. Cl.

CPC ..... *H01F 3/12* (2013.01); *H01F 27/24* (2013.01); *H01F 27/28* (2013.01); *H01F 2038/127* (2013.01)

(58) Field of Classification Search

CPC ..... H01F 38/12; H01F 27/24; H01F 27/28; H01F 2038/127; H01F 2003/103; H01F 3/14

See application file for complete search history.

(56) References Cited

U.S. PATENT DOCUMENTS

| | | | | |
|---|---|---|---|---|
| 4,546,753 | A * | 10/1985 | Pierret | H01F 3/14 123/634 |
| 4,990,881 | A * | 2/1991 | Ooyabu | H01F 3/14 336/107 |
| 2002/0007828 | A1* | 1/2002 | Murata | F02P 3/02 123/647 |
| 2002/0171524 | A1* | 11/2002 | Tsai | H01F 38/12 336/96 |
| 2005/0212635 | A1* | 9/2005 | Klocinski | H01F 38/12 336/90 |
| 2010/0271157 | A1* | 10/2010 | Talon | F01L 9/20 335/229 |
| 2012/0293033 | A1* | 11/2012 | Hisada | H02K 1/2766 310/156.01 |
| 2012/0299679 | A1* | 11/2012 | Kobayashi | H01F 38/12 336/212 |

(Continued)

FOREIGN PATENT DOCUMENTS

| | | |
|---|---|---|
| JP | 7-320960 | * 12/1995 |
| JP | 08-45753 | 2/1996 |

(Continued)

*Primary Examiner* — Mang Tin Bik Lian
(74) *Attorney, Agent, or Firm* — Nixon & Vanderhye P.C.

(57) ABSTRACT

An ignition coil for use in an internal combustion engine includes a primary coil, a secondary coil, a core, and a magnet. The core creates a closed magnetic circuit through which magnetic flux produced upon energization of the primary coil flows. The core has formed therein a gap through which the magnetic circuit passes. The magnet is disposed in the gap and has magnetic domains whose magnetization vectors are at least partially oriented obliquely relative to a gap direction. The orientation of the magnetization vectors in the magnet minimizes an energy loss when primary energy is transformed into secondary energy.

11 Claims, 29 Drawing Sheets

(56) References Cited

U.S. PATENT DOCUMENTS

| | | | | |
|---|---|---|---|---|
| 2014/0110508 | A1* | 4/2014 | Dames | H02K 15/00 318/135 |
| 2016/0169984 | A1* | 6/2016 | Werth | H01F 7/0273 324/244 |
| 2017/0126087 | A1* | 5/2017 | Soderberg | H02K 5/02 |
| 2018/0087926 | A1* | 3/2018 | Ausserlechner | G01D 5/165 |
| 2018/0350516 | A1* | 12/2018 | Idogawa | H01F 38/12 |
| 2020/0282463 | A1* | 9/2020 | Fujikawa | H01F 7/0205 |

FOREIGN PATENT DOCUMENTS

| | | |
|---|---|---|
| JP | 10-340821 | 12/1998 |
| JP | 2015-201555 | 11/2015 |
| JP | 6061284 | 12/2016 |

* cited by examiner

IGNITION COIL

CROSS REFERENCE TO RELATED DOCUMENT

The present application claims the benefit of priority of Japanese Patent Application No. 2019-151999 filed on Aug. 22, 2019, the disclosure of which is incorporated herein by reference.

BACKGROUND

1 Technical Field

This disclosure relates generally to an ignition coil.

2 Background Art

Japanese Patent First Publication No. 1996-045753 discloses an ignition coil equipped with a primary coil, a secondary coil magnetically coupled with the primary coil, a center core disposed inside the primary and secondary coils, and a ring-shaped outer peripheral core surrounding the center core.

The center core and the outer peripheral core form a closed magnetic path through which a magnetic flux, as produced by electrical excitation of the primary coil, passes. The ignition coil works to block supply of electrical current to the primary coil to change an amount of magnetic flux in the closed magnetic path, thereby inducing a secondary high voltage at the secondary coil.

The above ignition coil also includes a magnet disposed in an air gap between the center core and the outer peripheral core in an axial direction of windings of the primary and secondary coils. The magnet is used to magnetically bias the closed magnetic path in order to enhance a secondary voltage and a secondary energy. The magnet is magnetized in a direction opposite a direction of a magnetic field generated in the closed magnetic path when the primary coil is excited, thereby increasing a change in amount of magnetic flux in the closed magnetic path when the primary coil is de-energized. This enhances the secondary voltage and the secondary energy in the ignition coil.

The center core of the ignition coil has a flange which is formed on an end of the center core facing the magnet and extends outward radially. This results in an increased transverse sectional area of the flanged end of the center core close to the magnet. This enables the magnet to have an increased transverse sectional area facing the flanged end of the center core, thereby strengthening a magnetic field created by the magnetic bias.

The above ignition coil, however, faces the drawback in that there may be an energy loss when a primary electrical energy inputted to the primary coil is transformed into a secondary electrical energy created in the secondary coil. This will be described below in detail with reference to FIGS. 26 to 28. In the following discussion, a force which makes the magnet 93 generate a magnetic flux will be referred to as a magnet-magnetomotive force $F_{mag}$. A force which generates a magnetic flux arising from excitation of the primary coil 91 will be referred to as a coil-magnetomotive force $F_{coil}$.

FIG. 26 schematically illustrates the ignition coil 9 having a structure similar to that taught in the above publication. The magnet-magnetomotive force $F_{mag}$ and the coil-magnetomotive force $F_{coil}$ are, as can be seen in FIG. 26, opposed to each other. This causes, as demonstrated in FIG. 27, the magnet-magnetomotive force $F_{mag}$ to become larger than the coil-magnetomotive force $F_{coil}$ immediately after the primary coil 91 is energized, so that the magnetic flux $\varphi_{coil}$, as generated by the magnet-magnetomotive force $F_{mag}$, appears in the center core 96 and the outer peripheral core 97, without appearance of magnetic flux generated by the coil-magnetomotive force $F_{coil}$ in the center core 96 and the outer peripheral core 97. The primary current $I_1$ flowing in the primary coil 91 is proportional to the product of a reciprocal of the magnetic flux $\varphi_{coil}$ produced by the coil-magnetomotive force $F_{coil}$ and the time t (i.e., $I_1 \sim t/\varphi_{coil}$). This causes the primary current $I_1$ to be, as represented in FIG. 29, elevated rapidly until time t1 from energization of the primary coil 91.

Afterwards, when the coil-magnetomotive force $F_{coil}$ exceeds the magnet-magnetomotive force $F_{mag}$, it causes, as illustrated in FIG. 28, the magnetic flux $\varphi_{coil}$ to appear in the center core 96 and the outer peripheral core 97. This results in a decrease in rate of an increase in primary current $I_1$ after time t1.

In a period of time where the magnet-magnetomotive force $F_{mag}$ is larger than the coil-magnetomotive force $F_{coil}$ between start of energization of the primary coil 91 and time t1, there is, as described above, no magnetic flux produced by the coil-magnetomotive force $F_{coil}$ in the center core 96 and the outer peripheral core 97. The primary energy supplied to the primary coil 91 between the start of energization of the primary coil 91 and time t1 will, therefore, be a loss contributing not to generation of the secondary energy. The primary current $I_1$, as can be seen in FIG. 29, increases rapidly between the start of energization of the primary coil 91 and the time t1, thereby resulting in an increase in the energy loss. In FIG. 29, the energy loss is indicated by hatching.

SUMMARY

It is, thus, an object of this disclosure to provide an ignition coil designed to minimize an energy loss when a primary energy is transformed into a secondary energy.

According to one aspect of this disclosure, there is provided an ignition coil which comprises: (a) a primary coil and a secondary coil which are magnetically coupled with each other; (b) a core which defines a closed magnetic circuit in which magnetic flux, as produced by energization of the primary coil, flows, the core having formed therein a gap through which the magnetic circuit passes; and (c) a magnet which is disposed in the gap of the core. The magnet has magnetization vectors at least a portion of which are inclined relative to a gap direction, which will be specifically defined later.

The magnet, as described above, has magnetic domains with the magnetization vectors at least a portion of which are inclined relative to the gas direction. A magnet-magnetomotive force produced by the magnet is oriented in the same direction as that in which the magnetization vectors are oriented. A coil-magnetomotive force which is produced by the primary coil and acts on the magnet is oriented in the gasp direction. If an angle which the magnetization vectors make with the gas direction is defined as θ, the magnet-magnetomotive force has a component opposed to the coil-magnetomotive force (i.e., a component of the magnet-magnetomotive force oriented in the gap direction). The component is, therefore, smaller than the magnet-magnetomotive force.

This causes the coil-magnetomotive force to exceed the above component of the magnet-magnetomotive force quickly after the primary coil is energized, so that the coil-magnetomotive force creates magnetic flux quickly in the whole of the core. This minimizes an energy loss when primary energy is transformed into secondary energy in the ignition coil.

Upon de-energization of the primary coil, a large degree of magnet-magnetomotive force oriented along the magnetization vectors is also exerted by the magnet on the core, thereby resulting in an increased change in amount of magnetic flux when the primary coil is switched from an energized stat to a de-energized state.

The above structure of the ignition coil is, therefore, capable of minimizing an energy loss when the primary energy is transformed into the secondary energy.

Symbols in the claims are used only to indicate correspondences to parts discussed in the following embodiments and do not limit the technical scope of the invention.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

First Embodiment

Figure 1:
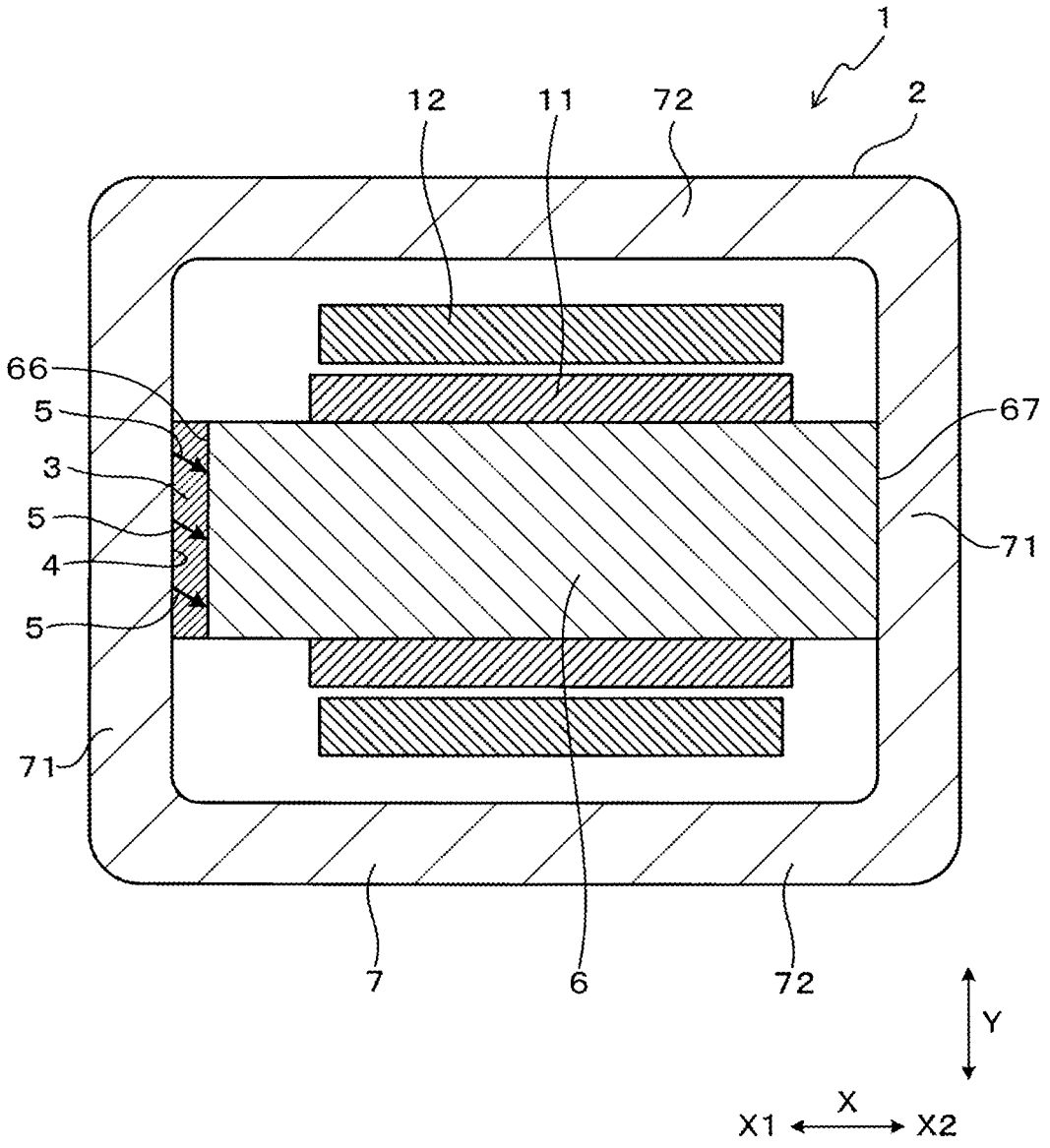
FIG. 1 is a sectional view taken in a Z-direction of an ignition coil according to the first embodiment.

The ignition coil 1 according to the first embodiment will be described below with reference to FIGS. 1 to 6. The ignition coil 1, as clearly illustrated in FIGS. 1 and 2, includes the primary coil 11, the secondary coil 12, the core 2, and the magnet 3.

Figure 4:
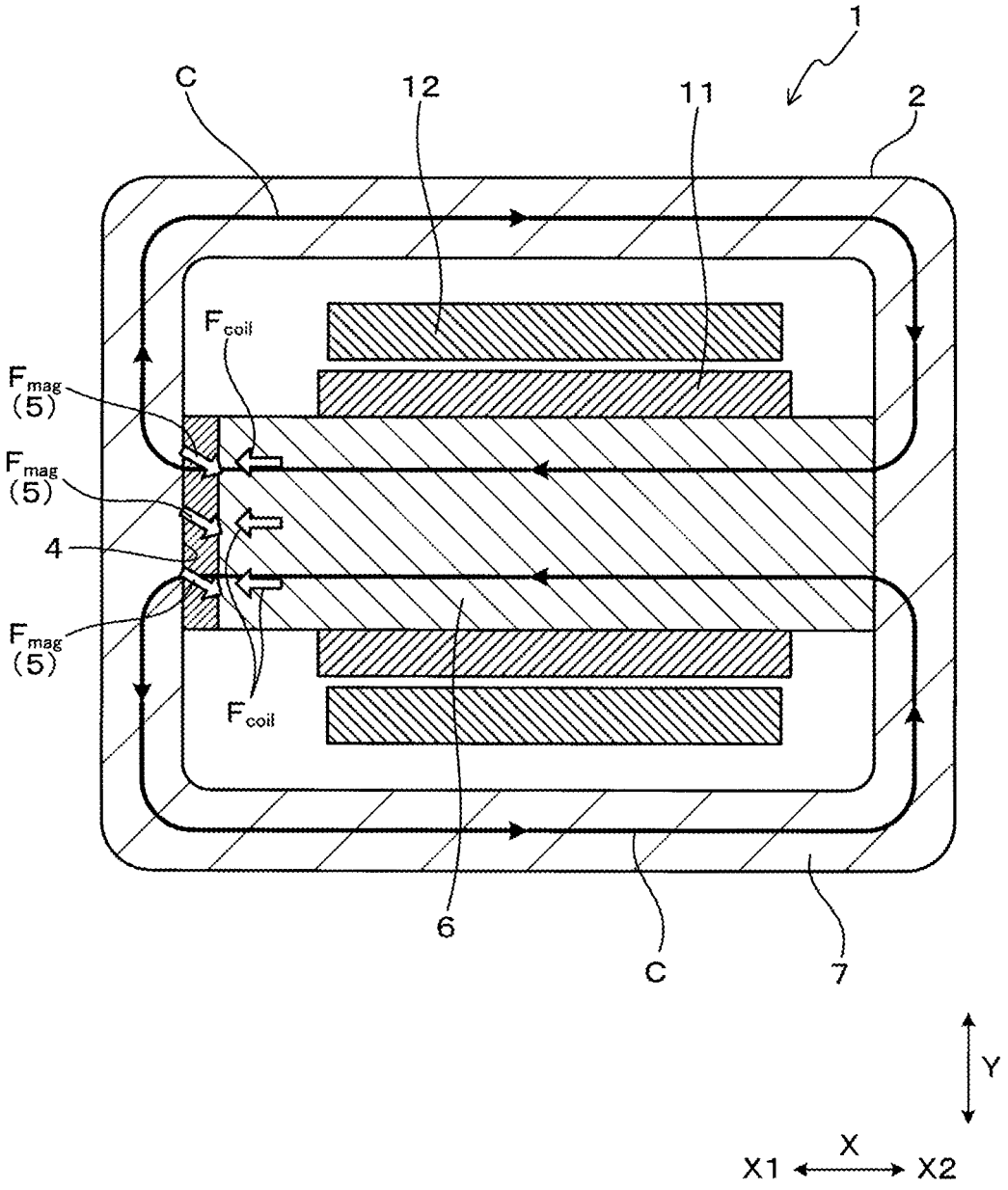
FIG. 4 is a sectional view, as taken along a direction perpendicular to a Z-direction, which illustrates flows of magnetic fluxes produced in an ignition coil in the first embodiment upon energization of a primary coil.
Figure 6:
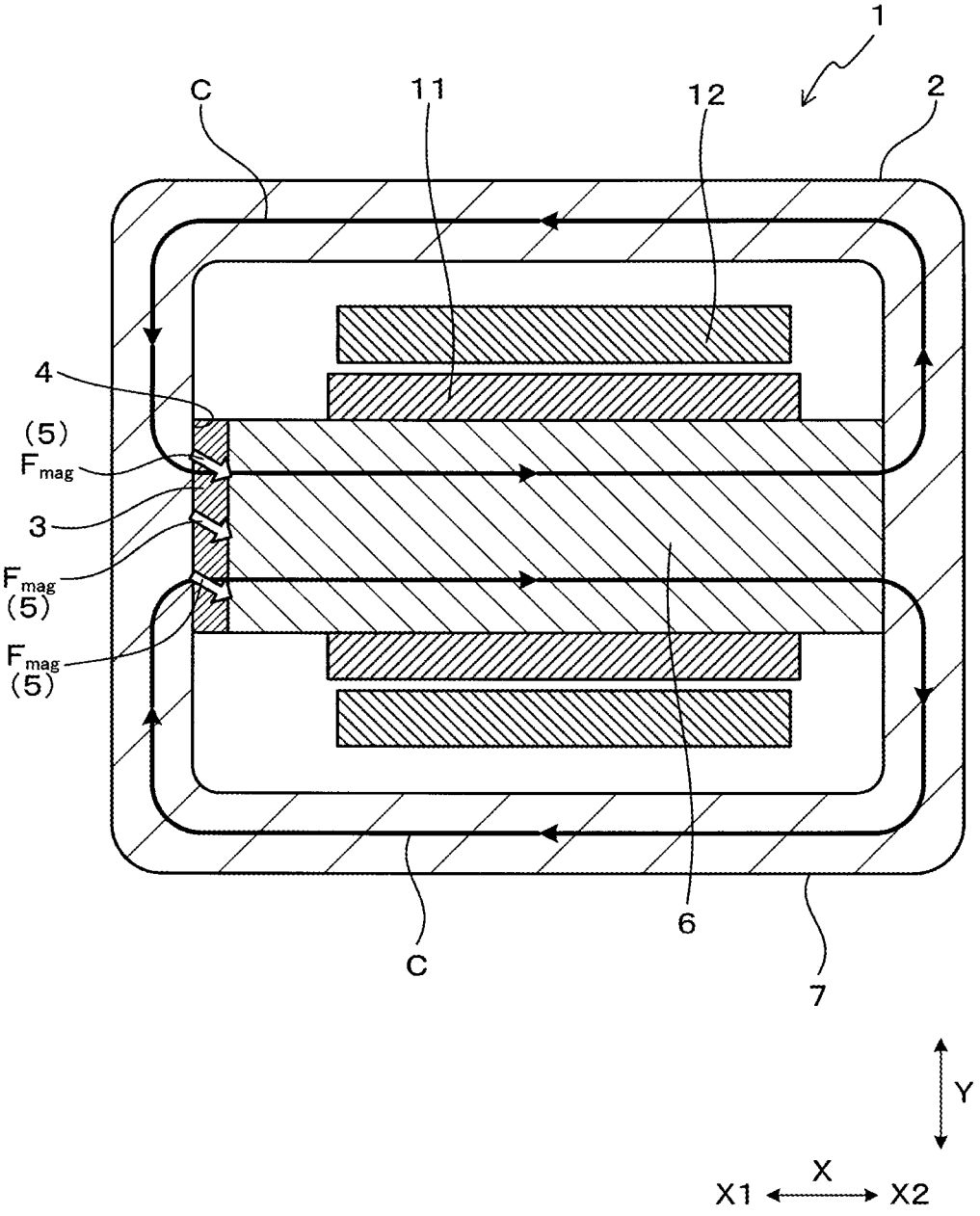
FIG. 6 is a section view, as taken along a direction perpendicular to a Z-direction of an ignition coil in the first embodiment, which demonstrates flows of magnetic fluxes produced upon de-energization of a primary coil.

The primary coil 11 and the secondary coil 12 are magnetically coupled with each other. The core 2, as illustrated in FIGS. 4 and 6, creates closed magnetic circuits C through which magnetic flux, as generated upon excitation of the primary coil 11, passes. FIG. 4 illustrates the closed magnetic circuits C through which magnetic flux, as produced upon energization of the primary coil 11, passes. FIG. 6 illustrates the closed magnetic circuits C through which magnetic flux, as produced upon deenergization of the primary coil 11, passes.

The magnet 3 is arranged in the gap 4 which is formed in the core 2 and lies in the closed magnetic circuits C. In other words, the core 2 has formed therein the gap 4 through which the magnetic circuits C pass. The magnet 3 is magnetized to have magnetic domains at least a portion of which have magnetization vectors 5 inclined relative to a gap direction which will be described later in detail.

The ignition coil 1 will be described below in more detail. The ignition coil 1 may be used in internal combustion engines of automotive vehicles or co-generation systems. In use, the ignition coil 1 is connected to a spark plug (not shown) installed in the internal combustion engine and works to apply high-voltage to the spark plug.

The ignition coil 1 is engineered to induce high-voltage at the secondary coil 12 with a change in electrical current with time in the primary coil 11. The primary coil 11 is supplied with electrical power from an external power source arranged outside the ignition coil 1. The secondary coil 12 is electrically connected to the spark plug to which the ignition coil 1 is connected.

Figure 2:
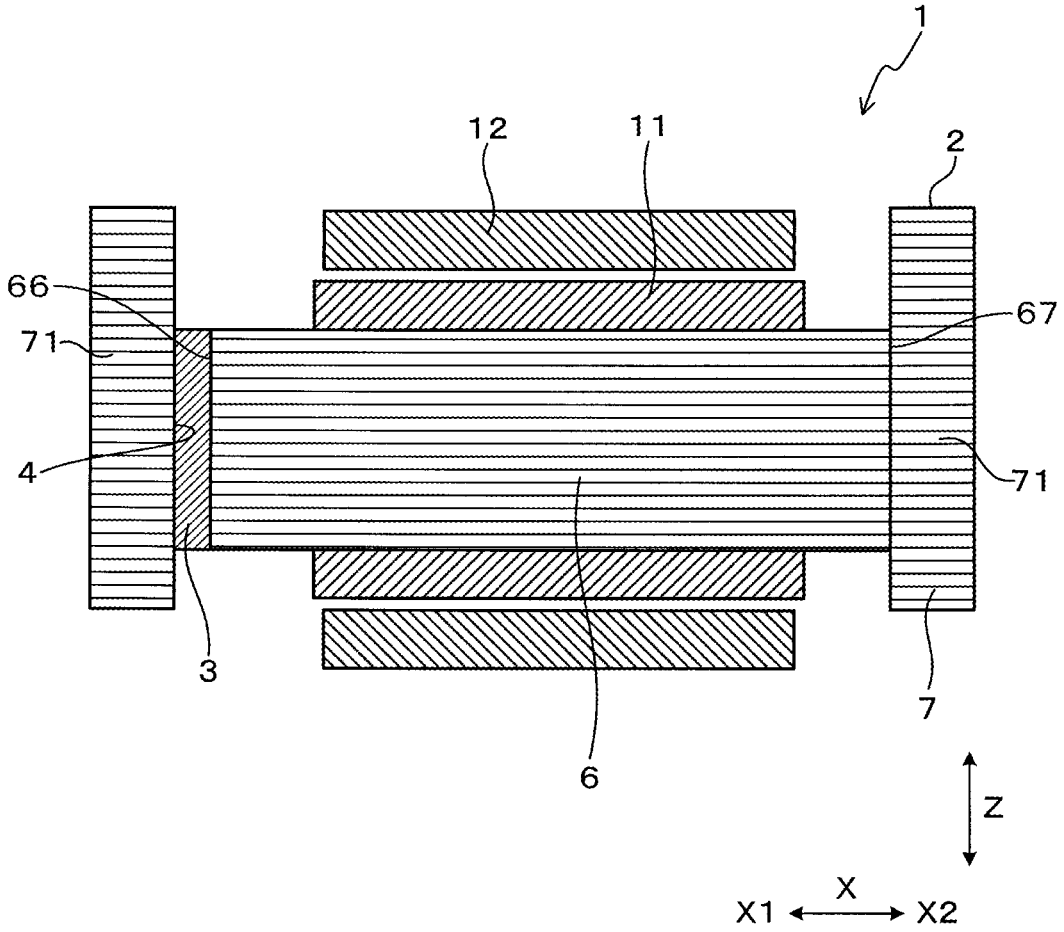
FIG. 2 is a sectional view taken in a direction perpendicular to a Y-direction of an ignition coil according to the first embodiment.

The primary coil 11 and the secondary coil 12 are, as can be seen in FIGS. 1 and 2, arranged coaxially with each other. The secondary coil 12 is located radially outside the primary coil 11. In the following discussion, a direction in which center axes of windings of the primary coil 11 and the secondary coil 12 extend will also be referred to as an X-direction.

The core 2, as can be seen in FIGS. 1 and 2, includes the center core 6 and the outer peripheral core 7. Each of the center core 6 and the outer peripheral core 7 is, as clearly illustrated in FIG. 2, made up of a stack of magnetic steel plates laid to overlap each other in the Z-direction perpendicular to the X-direction. Each of the magnetic steel plates is made from a soft magnetic material. Each of the center core 6 and the outer peripheral core 7 has a given thickness in the Z-direction.

Figure 3:
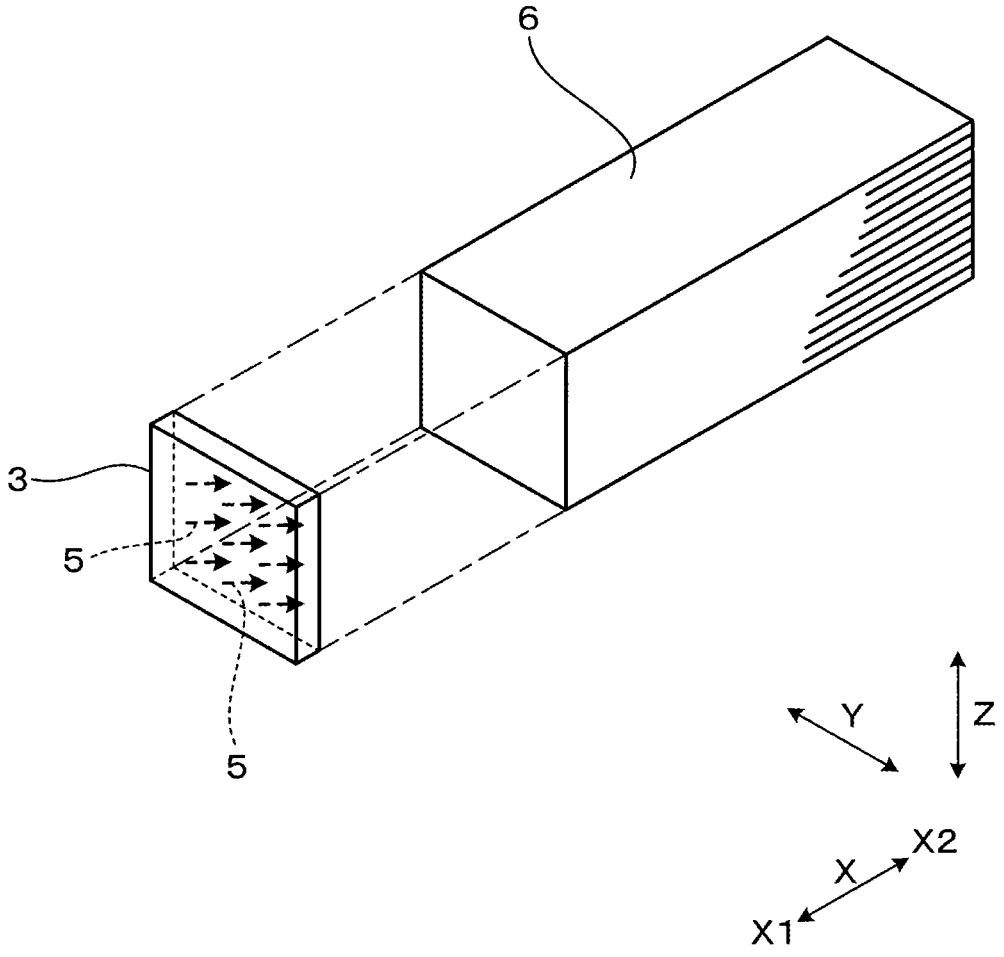
FIG. 3 is an exploded perspective view of a center core and a magnets of an ignition coil in the first embodiment.

The center core 6 is disposed radially inside inner peripheries of the primary coil 11 and the secondary coil 12. The center core 6 is, as illustrated in FIGS. 1 to 3, shaped to have a length extending in the X-direction.

The outer peripheral core 7 is, as illustrated in FIGS. 1 and 2, arranged radially outside outer peripheries of the primary coil 11 and the secondary coil 12. The outer peripheral core 7 is, as can be seen in FIG. 1, of a rectangular cylindrical shape surrounding the center core 6 in four directions perpendicular to the X-direction. In other words, the outer peripheral core 7 includes a pair of first side walls 71 opposed to each other in the X-direction and a pair of second side walls 72 opposed to each other in the Y-direction perpendicular both to the X-direction and to the Z-direction. The outer peripheral core 7 is, as illustrated in FIG. 2, shaped to have a size larger than that of the center core 6 and has portions lying outside the center core 6 in the Z-direction.

The center core 6, as illustrated in FIGS. 1 and 2, has a given length with the first end 66 (i.e., a left end, as viewed in FIGS. 1 and 2) and the second end 67 (i.e., a right end, as viewed in FIGS. 1 and 2) which are opposed to each other in the X-direction. The first end 66 of the center core 6 faces the first side walls 71 of the outer peripheral core 7 in the X-direction through the gap 4. In other words, the gap 4 is created between the center core 6 and the outer peripheral core 7 in the X-direction.

In this disclosure, the above described gap direction is defined as a direction in which surfaces of the core 2 face each other through the gap 4, in other words, surfaces of the core 2 which defines the gap 4 therebetween are opposed to each other at a minimum distance therebetween. Specifically, in this embodiment, the first end 66 of the center core 6 faces an adjacent one of the first side walls 71 of the outer peripheral core 7 at a minimum distance away from each other in the X-direction. (i.e., the lengthwise direction of the center core 6). In this embodiment, the gap direction may be defined as being identical with the X-direction that is an axial direction of windings of the primary coil 11 and the secondary coil 12. In this embodiment, the gap direction may also be defined as a direction in which the closed magnetic circuits C pass through the magnet 3 and a portion (i.e., the center core 6) of the core 2 which is aligned with the magnet 3 and surrounded by the primary coil 11 and the secondary coil 12.

The magnet 3 is disposed in the gap 4. In the following discussion, a direction from the center 6 toward the magnet 3 in the X-direction will also be referred to as a frontward direction X1, while a direction opposite the frontward direction X1 will also be referred to as a rearward direction X2. The terms "frontward" or "rearward" are used for the sake of convenience regardless of orientation of the internal combustion engine or the ignition coil 1 installed in the vehicle.

The magnet 3 works to magnetically bias the center core 6 to increase a rate of change in magnetic flux upon de-energization of the primary coil 11 to enhance voltage induced at the secondary coil 12 in order to improve an output voltage (i.e., secondary voltage) developed by the ignition coil 1. The magnet 3, as illustrated in FIGS. 1 to 3, has a given thickness in the X-direction. The magnet 3 has a shape substantially contoured to conform with that of the first end 66 of the center core 6, as viewed in the X-direction. The magnet 3 occupies the whole of the first end 66 of the center core 6.

Figure 5:
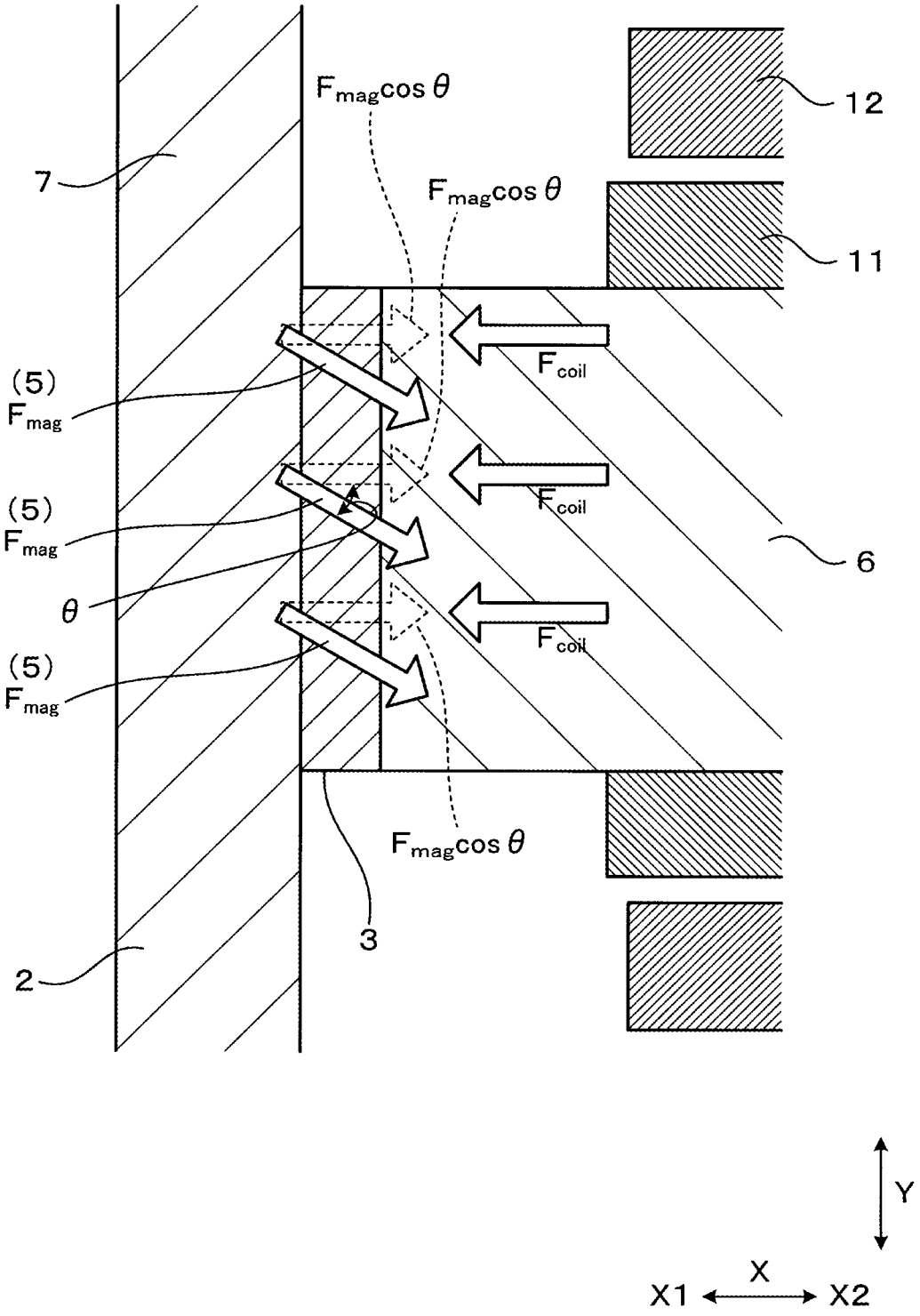
FIG. 5 is an explanatory enlarged view which illustrates a region around a magnet and shows magnet-produced magnetomotive force and coil-produced magnetomotive force.

The magnet 3, as illustrated in FIGS. 1, 3, and 5, has the magnetization vectors 5 in magnetic domains thereof which are oriented in the same direction. An orientation from an initial point to an end point of each of the magnetization vectors 5 is directed obliquely in one of opposite directions in the Y-direction. In other words, each of the magnetization vectors 5 is inclined at a given angle (excluding zero) relative to the first end 66 of the center core 6 or the inner surface of the first side wall 71. An acute angle θ which each of the magnetization vectors 5 of the magnet 3 makes with the X-direction is selected to meet a relation of $0° < \theta < 90°$. In this embodiment, the angle θ meets a relation of $10° < \theta < 30°$. For example, the magnet 3 may be produced by magnetizing a base material in a first direction and cutting the base material in a second direction oblique to the first direction.

The primary coil 11, the secondary coil 12, the center core 6, the outer peripheral core 7, and the magnet 3 are disposed in a resinous casing, not shown, and sealed by, for example, a thermo-setting resin within the casing.

The magnetic flux, as generated upon energization or de-energization of the primary coil 11, will be described below with reference to FIGS. 4 to 6. For the sake of convenience, FIGS. 4 and 5 show the magnetization vectors 5 and the magnet-magnetomotive force $F_{mag}$ (i.e., force making the magnet 3 generate magnetic flux) using the same arrows. The magnetic flux generated by excitation of the primary coil 11 will first be discussed with reference to FIGS. 4 and 5.

The energization of the primary coil 11 causes the coil-magnetomotive force $F_{coil}$ to act on the center core 6 and the outer peripheral core 7, thereby generating magnetic flux in the closed magnetic circuits C, as schematically illustrated in FIG. 4, in the center core 6 and the outer peripheral core 7. The coil-magnetomotive force $F_{coil}$ acting near the magnet 3 is oriented in a direction opposite a direction of the magnetization vectors 5 in the magnet 3 in the X-direction. The magnetization vectors 5 in the magnet 3 are, as illustrated in FIG. 5, inclined at the angle θ to the X-direction. The magnet-magnetomotive force $F_{mag}$ is oriented parallel to the magnetization vectors 5, that is, inclined at the angle θ relative to the X-direction.

The magnet-magnetomotive force $F_{mag}$, therefore, has a component $F_{mag}$ cos θ, as illustrated in FIG. 5, opposed to the coil-magnetomotive force $F_{coil}$. The component $F_{mag}$ cos θ of the magnet-magnetomotive force $F_{mag}$ which is opposed to the coil-magnetomotive force $F_{coil}$ is, therefore, smaller than the magnet-magnetomotive force $F_{mag}$. This causes the coil-magnetomotive force $F_{coil}$ to exceed the component $F_{mag}$ cos θ of the magnet-magnetomotive force $F_{mag}$ in the X-direction quickly after the primary coil 11 is energized, so that the coil-magnetomotive force $F_{coil}$ creates the magnetic flux quickly in the center core 6 and the outer peripheral core 7. The magnetic energy is, therefore, stored in the center core 6 and the outer peripheral core 7 quickly upon energization of the primary coil 11. Accordingly, the magnetic energy is stored in the center core 6 and the outer peripheral core 7 without a undesirable increase in primary energy consumed by the primary coil 11.

Next, the magnetic flux generated upon de-energization of the primary coil 11 will be described below with reference to FIG. 6.

When the primary coil 11 is de-energized, it causes a coil-magnetomotive force produced in the center core 6 and the outer peripheral core 7 upon energization of the primary coil 11 to disappear, so that magnetic flux is developed in the core 2 by the magnet-magnetomotive force $F_{mag}$ oriented in the same direction as the magnetization vectors 5. This causes the secondary voltage to be developed at the secondary coil 12 as a function of a change in amount of magnetic flux between when the primary coil 11 is energized and when the primary coil 11 is de-energized.

The above structure of the ignition coil 1 offers the following beneficial advantages.

The ignition coil 1 is designed to have at least one(s) of the magnetic vectors 5 in the magnet 3 which is inclined relative to the gap direction (i.e., a direction in which the center core 6 and the outer peripheral core 7 face each other at a minimum distance through the gap 4 in which the magnet 3 is disposed). The magnet-magnetomotive force $F_{mag}$ produced by the magnet 3 is oriented in the same direction as the magnetization vectors 5, while the coil-magnetomotive force acting on the magnet 3 is oriented in the gap direction. Accordingly, the inclination of the magnetization vectors 5 at an angle θ relative to the gap direction causes the magnet-magnetomotive force $F_{mag}$ to have the component $F_{mag}$ cos θ which is opposed to the coil-magnetomotive force $F_{coil}$, i.e., in the gap direction and smaller than the magnet-magnetomotive force $F_{mag}$. This causes the coil-magnetomotive force $F_{coil}$ to exceed the component $F_{mag}$ cos θ of the magnet-magnetomotive force $F_{mag}$ quickly just after the primary coil 11 is energized, so that the coil-magnetomotive force $F_{coil}$ creates the magnetic flux quickly in the whole of the core 2 upon energization of the primary coil 11, thereby minimizing an energy loss when the primary energy is transformed into the secondary energy.

When the primary coil 11 is de-energized, it causes the large magnet-magnetomotive force $F_{mag}$ to be exerted by the magnet 3 on the core 2 along the magnetization vectors 5 in the magnet 3, thereby resulting in a large change in amount of magnetic flux from when the primary coil 11 is energized. The magnitude of the magnet-magnetomotive force $F_{mag}$ depends upon the product of the thickness and magnetic coercive force of the magnet 3. The energy loss occurring when the primary energy is transformed into the secondary energy may be reduced by orienting the magnetization vectors 5 in the magnet 3 parallel to the X-direction and also decreasing the thickness of the magnet 3, but however, it will result in a undesirable decreased magnitude of the magnet-magnetomotive force $F_{mag}$, thereby leading to an insufficient biasing of the center core 6. In order to alleviate such a drawback, the magnetic coercive force of the magnet 3 may be increased, however, a magnet used in typical ignition coils is made of a neodymium magnet having a high density of remanent magnetic flux Br and a high magnetic coercive force Hcj. It is, thus, practically difficult to make the magnet 3 from material having the density of remanent magnetic flux Br and the magnetic coercive force Hcj which are higher than those of the neodymium magnet.

The reduction in energy loss when the primary energy is transformed into the secondary energy will also decrease an unwanted amount of thermal energy generated in the ignition coil 1. An ignition device designed to stop supplying electrical power to the primary coil 11 when the temperature of the ignition coil 1 exceeds a given value is, therefore, capable of increasing an energized duration of the primary coil 11 by reducing the unwanted amount of thermal energy generated in the ignition coil 1, thereby increasing the secondary energy.

The increase in secondary energy enables the magnet 3 to be made from an increased variety of different kinds of materials, thus enabling the magnet 3 to be made from an inexpensive material.

As apparent from the above discussion, the ignition coil 1 in this embodiment is capable of minimizing an energy loss occurring when the primary energy is transformed into the secondary energy.

Second Embodiment

Figure 7:
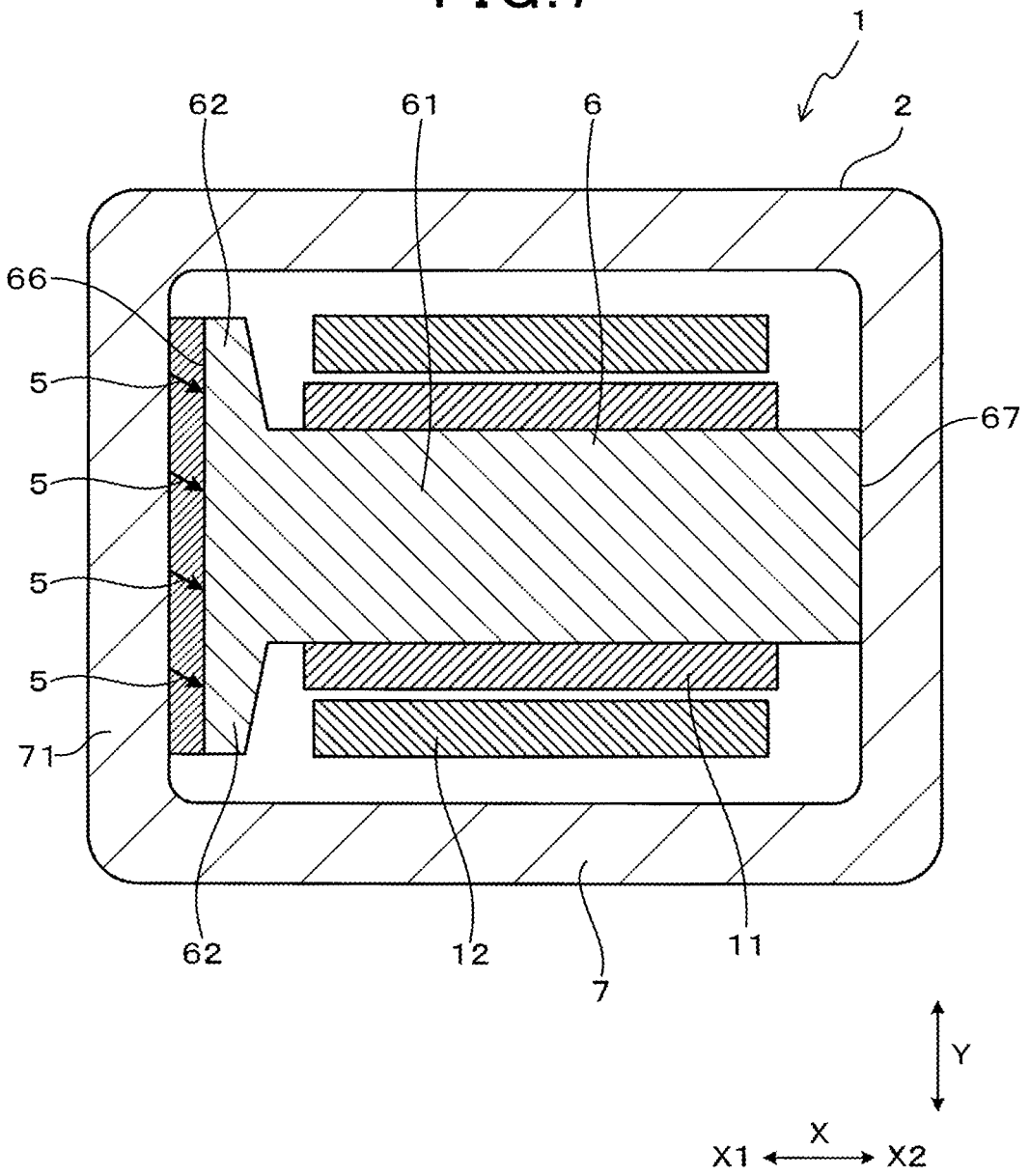
FIG. 7 is a sectional view, as taken along a direction perpendicular to a Z-direction of an ignition coil according to the second embodiment.
Figure 8:
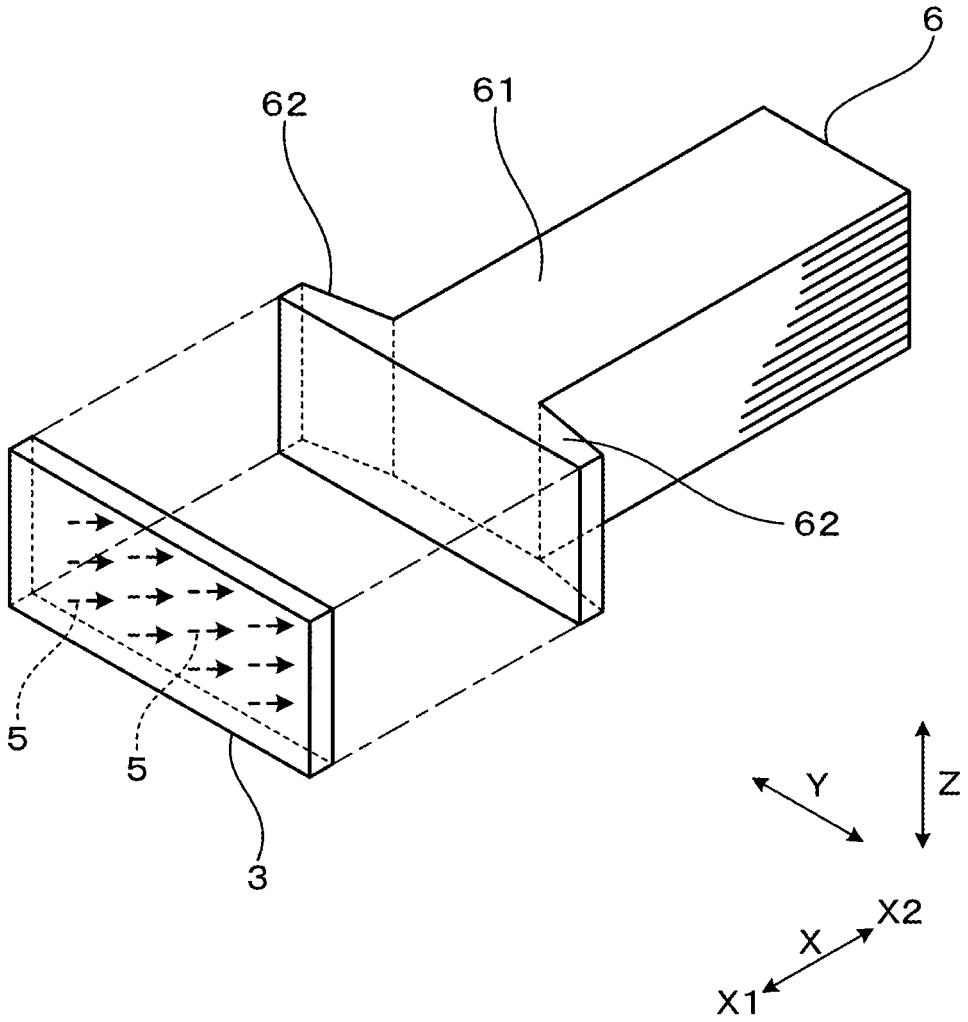
FIG. 8 is an exploded perspective view which illustrates a center core and a magnet of an ignition coil in the second embodiment.

FIGS. 7 and 8 illustrate the ignition coil 1 according to the second embodiment which is different in configuration of the center core 6 from the first embodiment.

The center core 6, as clearly illustrated in FIG. 8, includes the body 61 and a pair of flanges 62. The body 61 has a given length extending in the X-direction. Specifically, the body 61 is of a quadrangular prism shape elongated in the X-direction and has a transverse section uniform in shape over the length thereof.

The flanges 62 protrude outward in opposite directions along the Y-direction from an end of the body 61 which faces the adjacent first side wall 71 of the outer peripheral core 7. The end of the body 61 and the flanges 62 define the first end 66 of the center core 6. Each of the flanges 62 extends from the whole of one of sides of the end of the body 61 in the Y-direction.

Each of the flanges 62 has a rear surface which faces in the rearward direction X2 and is inclined from the outer periphery of the body 61 obliquely in the forward direction X1. Each of the flanges 62 has a front surface which faces in the frontward direction X1 and lies flush with the end of the body 61 facing the first side wall 71, thereby defining the first end 66 of the center core 6. In this embodiment, the body 61 and the flanges 62 are formed integrally with each other. In other words, the magnetic steel plates making the center core 6 form both the body 61 and the flanges 62.

The magnet 3 is of a rectangular plate-shape and has a thickness in the X-direction. The magnet 3 has a shape substantially contoured to conform with that of the first end 66 of the center core 6, as viewed in the X-direction. In other words, the magnet 3 occupies or overlaps the whole of the first end 66 (i.e., the front surface) of the center core 6. The magnet 3 has the magnetization vectors 5 oriented in the same direction. An orientation from an initial point to an end point of each of the magnetization vectors 5 is directed obliquely in one of opposite directions along the Y-direction. Other arrangements of the ignition coil 1 are identical with those in the first embodiment, and explanation thereof in detail will be omitted here. The same reference numbers in the second and following embodiments as in the preceding embodiments refer to the same or similar parts unless otherwise specified.

The structure of the ignition coil 1 in the second embodiment offers the same beneficial advantages as those in the first embodiment.

Third Embodiment

Figure 9:
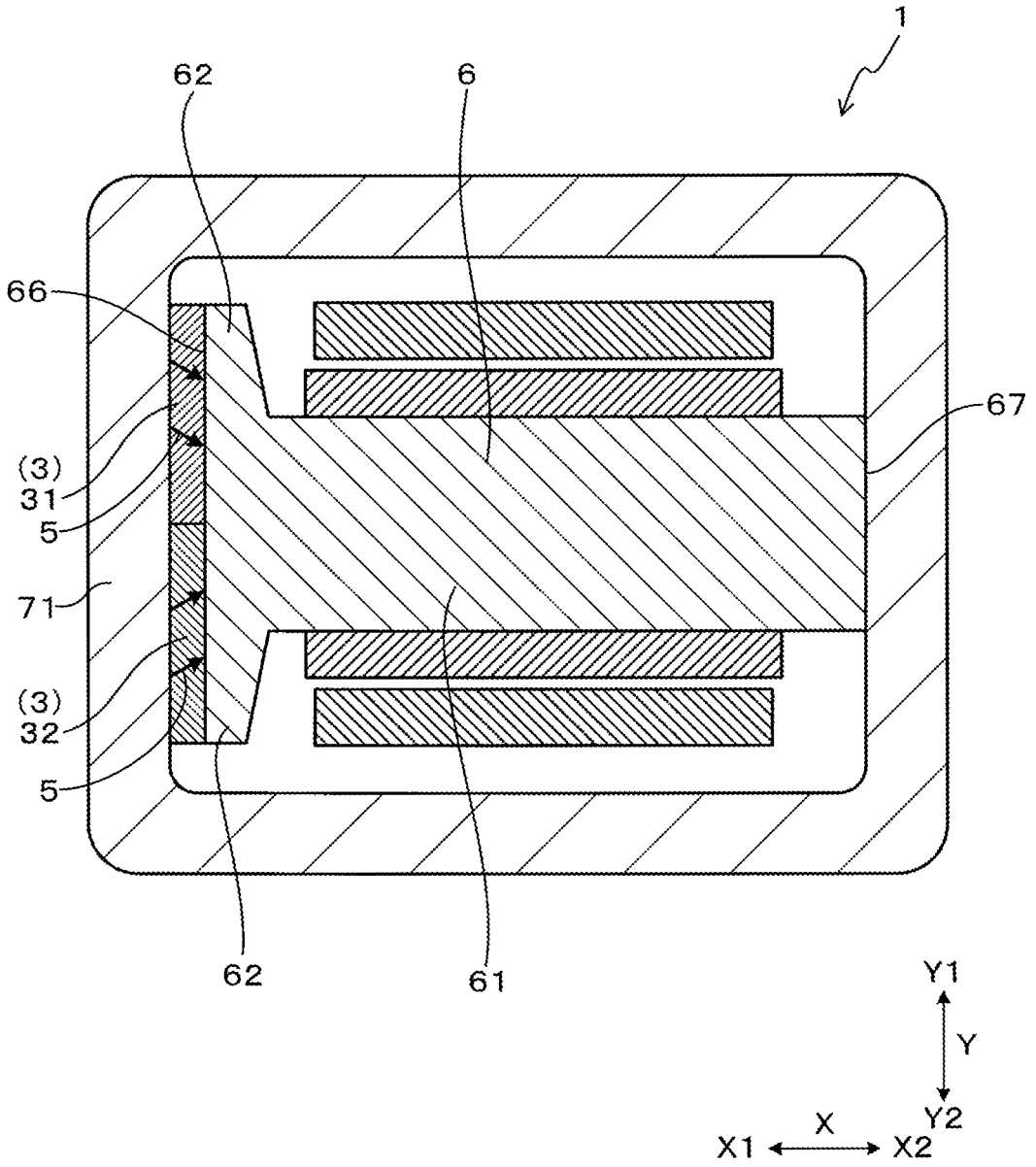
FIG. 9 is a sectional view, as taken along a direction perpendicular to a Z-direction of an ignition coil according to the third embodiment.
Figure 10:
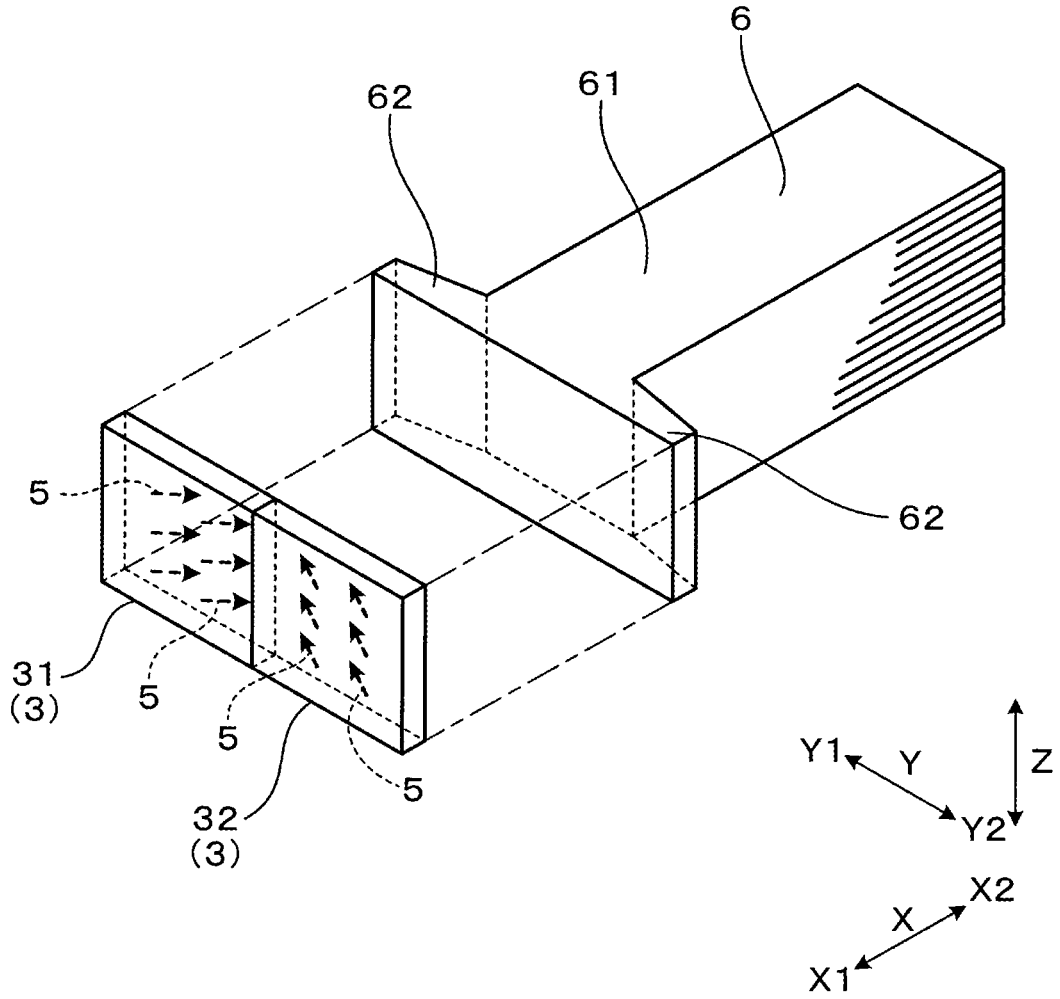
FIG. 10 is an exploded perspective view which illustrates a center core and magnets of an ignition coil in the third embodiment.
Figure 11:
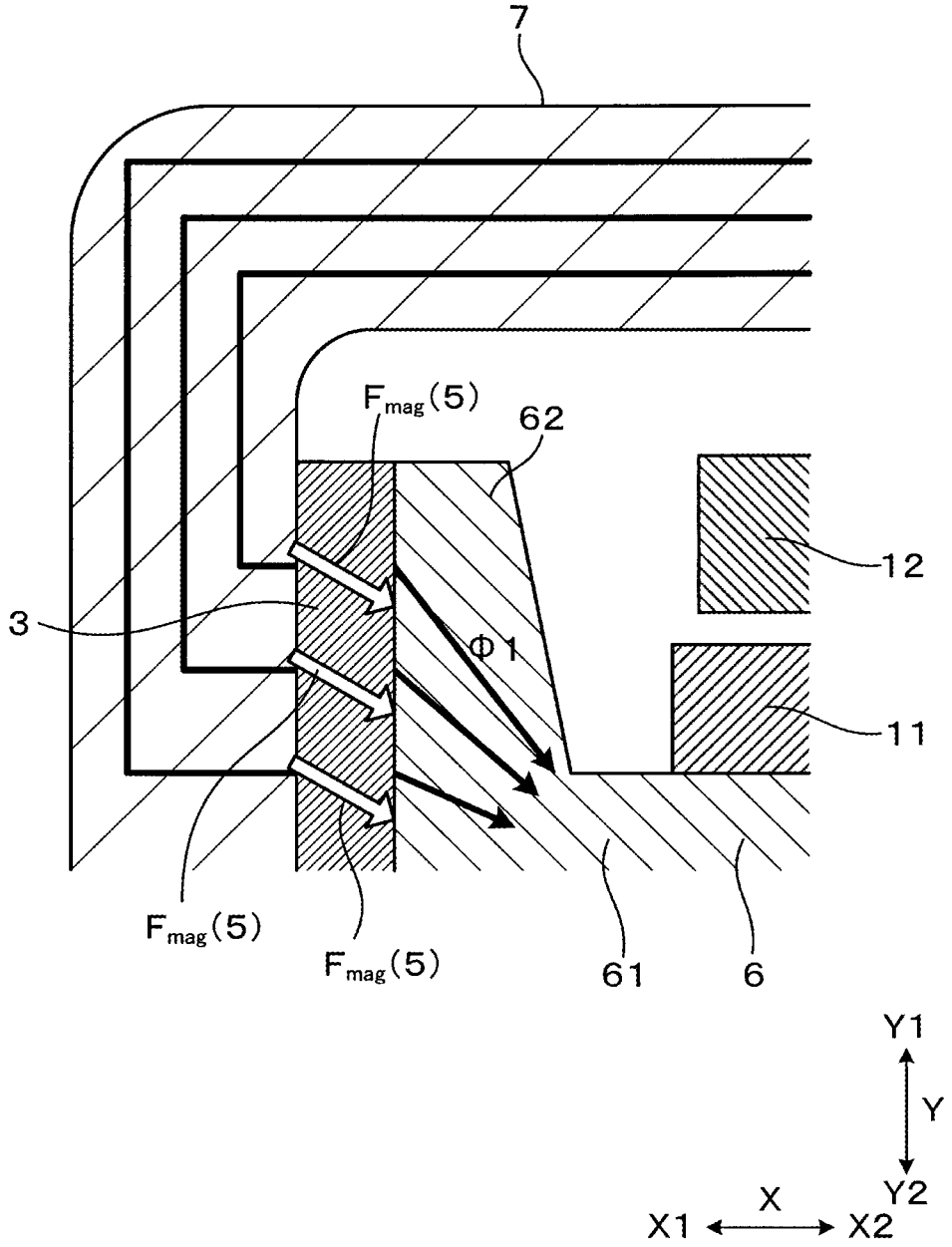
FIG. 11 is a partially enlarged sectional view which illustrates a region around a magnet and a core of an ignition coil in the third embodiment and demonstrates orientation of flows of magnetic fluxes and magnetization vectors produced in the core.

FIGS. 9 to 11 illustrate the ignition coil 1 according to the third embodiment which is different only in structure of the magnet 3 from the second embodiment.

The ignition coil 1 is, as illustrated in FIGS. 9 and 10, equipped with a plurality of magnets 3. The magnets 3 are arranged in alignment with each other in a direction (i.e., the Y-direction) perpendicular to the X-direction and face the first end 66 of the center core 6 in the X-direction. Each of the magnets 3 has the magnetization vectors 5 inclined from the first side wall 71 obliquely in a direction opposite a direction in which the adjacent flange 62 protrudes from the end of the center core 6 relative to the X-direction (i.e., the longitudinal center line of the center core 6). In other words, the magnetization vectors 5 are oriented obliquely radially inwardly at a given angle (excluding zero) relative to the longitudinal center line of the center core 6. At least one of the magnetization vectors 5 of at least one of the magnets 3 may be directed at the above inclined orientation.

The magnets 3 in this embodiment includes the first magnet 31 and the second magnet 32 which are aligned with each other in the Y-direction. In the following discussion, a region where the first magnet 31 lies and which is located further from the second magnet 32 in the direction Y1 (i.e., one of opposite directions along the Y-direction) will also be referred to as a Y1-side, while an opposite side will also be referred to as a Y2-side.

The first magnet 31 occupies an area of the first end 66 of the center core 6 which is located on the Y1-side. The second magnet 32 occupies an area of the first end 66 of the center core 6 which is located on the Y2-side. In the illustrated example, a boundary between the first and second magnets 31 and 32 is aligned with the longitudinal center line (i.e. the center axis) of the center core 6. The first magnet 31 at least partially faces an adjacent one of the flanges 62 in the X-direction. Similarly, the second magnet 32 at least partially faces an adjacent one of the flanges 62 in the X-direction.

The first magnet 31 is designed to have the magnetization vectors 5 oriented in the same direction. An orientation from an initial point to an end point of each of the magnetization vectors 5 is directed backward obliquely in the direction Y2.

Similarly, the second magnet 32 has the magnetization vectors 5 oriented in the same direction. An orientation from an initial point to an end point of each of the magnetization vectors 5 is directed backward obliquely in the direction Y1. In other words, the magnetization vectors 5 in the second magnet 32 are oriented in a direction opposite that in which the magnetization vectors 5 in the first magnet 31 are oriented.

Other arrangements are identical with those in the second embodiment.

As apparent from the above discussion, the first magnet 31 and the second magnet 32 which face the flange 62 in the gap direction (i.e., the X-direction) have the magnetization vectors 5 oriented obliquely toward the longitudinal center line (i.e., the axis) of the center core 6, in other words, in directions opposite directions in which the flanges 62 extend outward from the center core 6. The above orientation of the magnetization vectors 5 in the first and second magnets 31 and 32 facilitates an increase in a change in amount of magnetic flux upon de-energization of the primary coil 11. This will also be described below.

When supply of electrical power to the primary coil 11 is cut, it will cause, as indicated by arrows in FIG. 11, magnetic fluxes φ1 which are produced in the flange 62 by the magnet-magnetomotive force $F_{mag}$ acting along the magnetization vectors 5 in the magnet 3 to be oriented obliquely in the rearward direction X2 toward the longitudinal center line of the body 61 of the center core 6, so that the magnetic fluxes φ1 flow from the flange 62 smoothly into the body 61, thereby securing an increased amount of magnetic flux flowing through the whole of the center core 6, that is, the core 2. This results in an increased change in amount of magnetic flux upon de-energization of the primary coil 11.

This embodiment, therefore, offers substantially the same beneficial advantages as those in the second embodiment.

Fourth Embodiment

Figure 12:
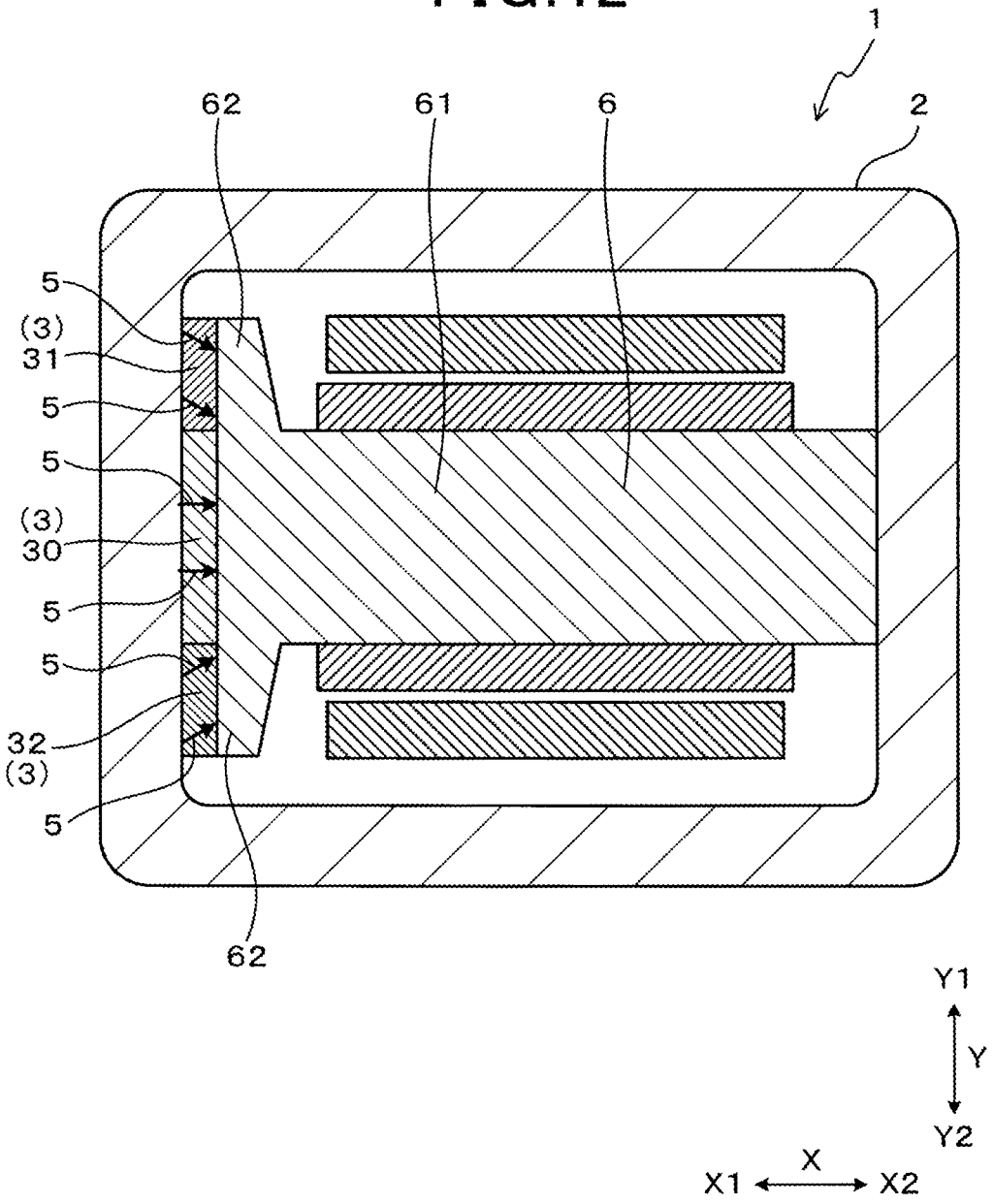
FIG. 12 is a sectional view, as taken along a direction perpendicular to a Z-direction of an ignition coil according to the fourth embodiment.
Figure 13:
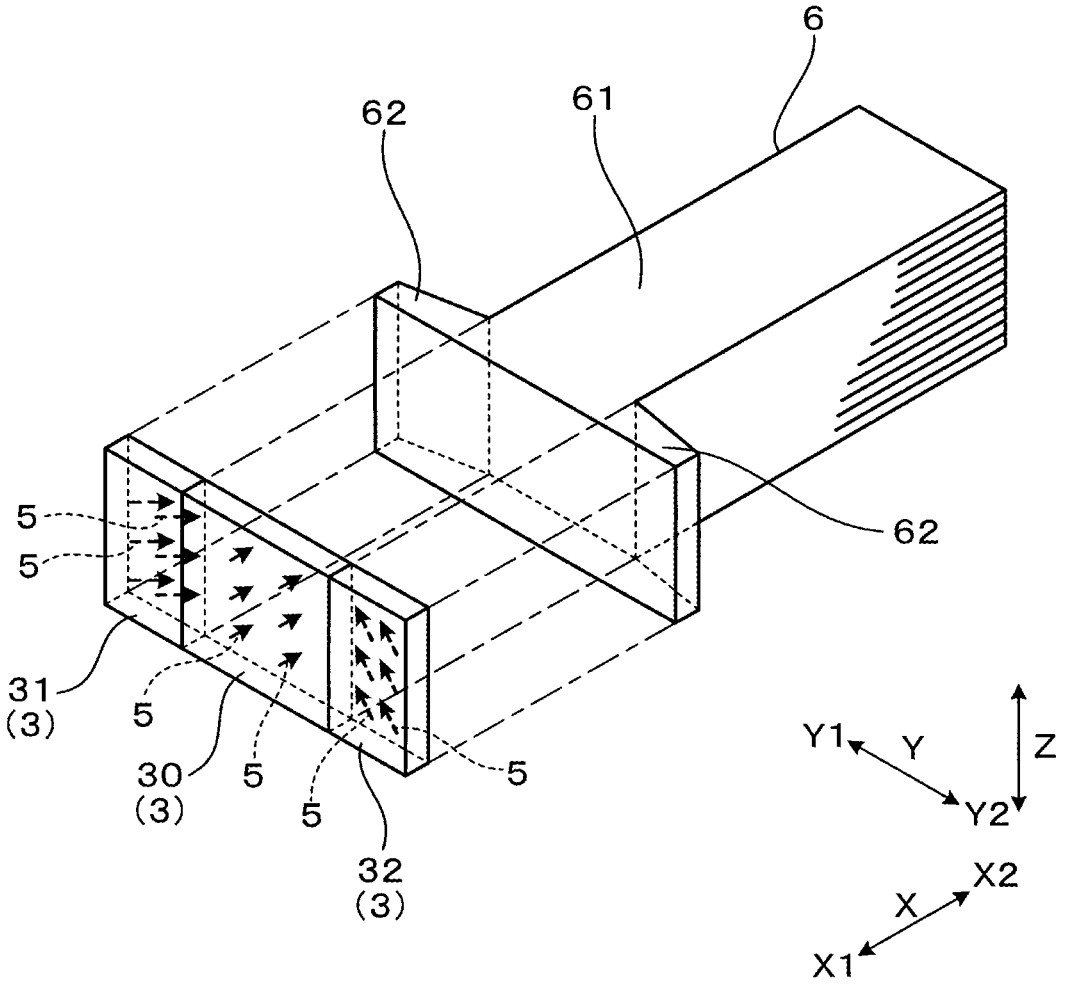
FIG. 13 is an exploded perspective view which illustrates a center core and magnets of an ignition coil in the fourth embodiment.

FIGS. 12 and 13 illustrate the ignition coil 1 according to the fourth embodiment which is different only in structure of the magnet 3 from the third embodiment. Other arrangements are substantially identical with those in the third embodiment.

The ignition coil 1 in this embodiment is equipped with three magnets 3 arranged in alignment with each other in the Y-direction. Specifically, the magnets 3 include the first magnet 31, the second magnet 32, and the third magnet 30. The first magnet 31 faces one of the flanges 62 which is located closer to the Y1-side and will also be referred to as a first flange. The second magnet 32 faces one of the flanges 62 which is located closer to the Y2-side and will also be referred to as a second flange. The third magnet 30 faces the body 61 of the center core 6 in the X-direction and will also be referred to as a core body-facing magnet.

The first magnet 31 is laid to overlap or fully occupy the whole of the front surface of the first flange 62 arranged on the Y1-side. The second magnet 32 is laid to overlap or fully occupy the whole of the front surface of the second flange 62 arranged on the Y2-side. The core body-facing magnet 30 is laid to overlap or fully occupy the whole of the front surface of the body 61 of the center core 6.

The first magnet 31 has the magnetization vectors 5 oriented in the same direction. Specifically, an orientation from an initial point to an end point of each of the magnetization vectors 5 in the first magnet 31 is directed in the rearward direction X2 and obliquely in the direction Y2.

The second magnet 32 has the magnetization vectors 5 oriented in the same direction. Specifically, an orientation from an initial point to an end point of each of the magnetization vectors 5 in the second magnet 32 is directed in the rearward direction X2 and obliquely in the direction Y1. The magnetization vectors 5 in the first magnet 31 are oriented in a direction opposite a direction in which the magnetization vectors 5 in the second magnet 32.

The core body-facing magnet 30 has the magnetization vectors 5 oriented in the same direction. Specifically, the magnetization vectors 5 in the core body-facing magnet 30 extend in the gap direction (i.e., the X-direction). An orientation from an initial point to an end point of each of the magnetization vectors 5 is direction from the front side X1 to the rear side X2.

Other arrangements of the ignition coil 1 are substantially the same as those in the third embodiment.

As apparent from the above discussion, the first magnet 31 and the second magnet 32 which face the flanges 62 in the gap direction (i.e., the X-direction) have the magnetization vectors 5, like in the third embodiment, oriented obliquely toward the longitudinal center line (i.e., the axis) of the center core 6, in other words, in directions opposite directions in which the flanges 62 extend outward from the center core 6. The magnetization vectors 5 in the core body-facing magnet 30 which faces the body 61 of the center core 6 in the X-direction extend substantially parallel to each other in the X-direction. The magnetization vectors 5 in the first magnet 31, the second magnet 32, and the third magnet 30 (i.e., the core body-facing magnet) are, therefore, directed toward a given portion of the body 61 of the center core 6 which is defined around the longitudinal center line of the center core 6. Such orientation of the magnetization vectors 5 in the first to third magnets 31, 32, and 30 facilitates an increase in a change in amount of magnetic flux upon de-energization of the primary coil 11. This will also be described below.

When supply of electrical power to the primary coil 11 is cut, it will cause magnetic fluxes which are generated in the flange 62 by the magnet-magnetomotive force $F_{mag}$ produced by the magnets 3 (i.e., the first and second magnets 31 and 32) which face the flanges 62 to be oriented in the rearward direction X2 obliquely toward the body 61 of the center core 6. Magnetic fluxes generated by the magnet-magnetomotive force $F_{mag}$ produced by the magnet 3 (i.e., the third magnet 30) which faces the body 61 of the center core 6 flow in the X-direction. The use of the magnets 31, 32, and 30 facilitates collection of magnetic fluxes from the flanges 62 along the length of the body 61 of the center core 6 in the rearward direction X2 upon de-energization of the primary coil 11, thereby resulting in an increased amount of magnetic flux flowing in the body 61 of the center core 61 in the rearward direction X2, that is, an increased change in amount of magnetic flux upon de-energization of the primary coil 11.

This embodiment, therefore, offers substantially the same beneficial advantages as those in the third embodiment.

Fifth Embodiment

Figure 14:
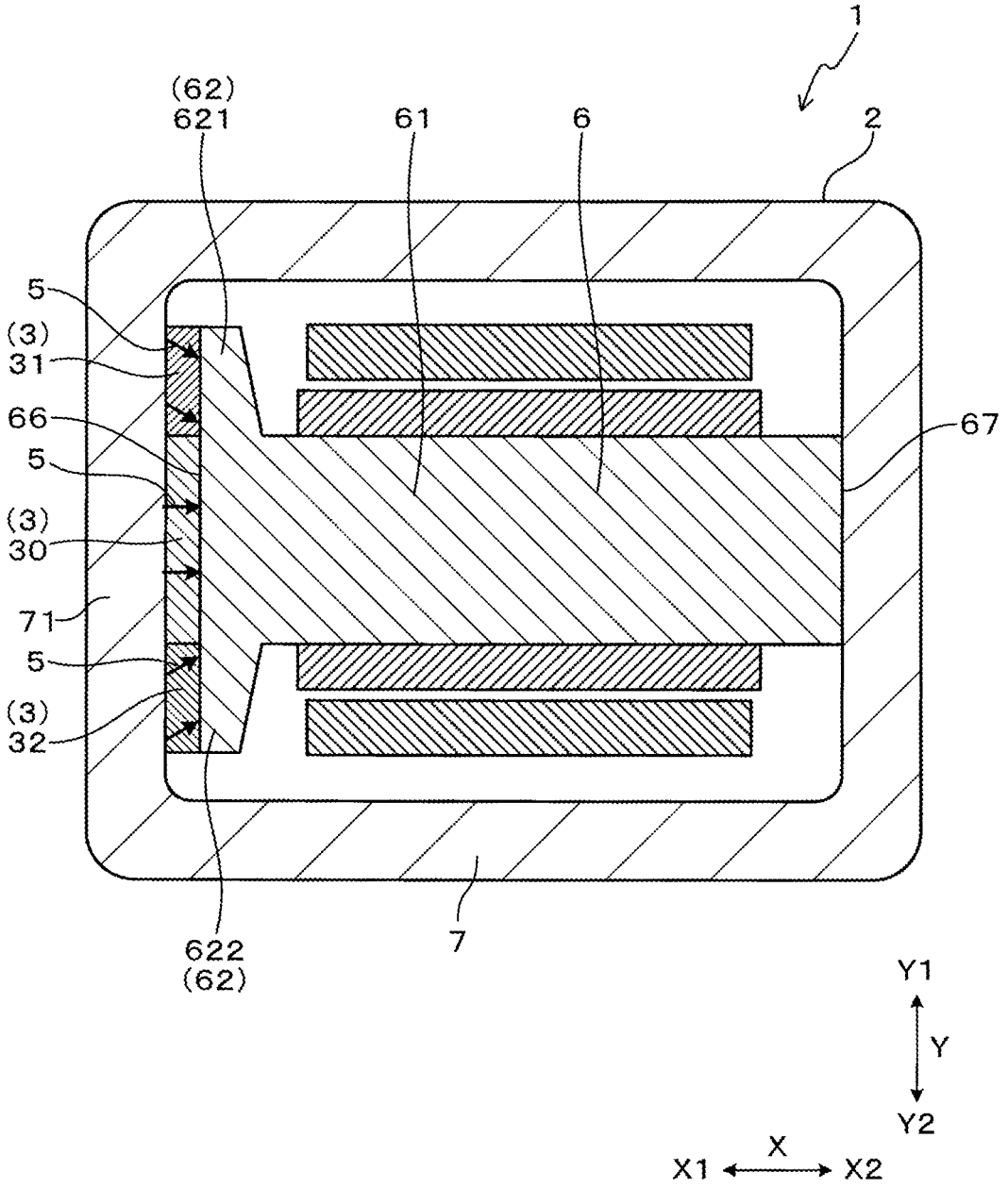
FIG. 14 is a sectional view, as taken along a direction perpendicular to a Z-direction of an ignition coil according to the fifth embodiment.
Figure 15:
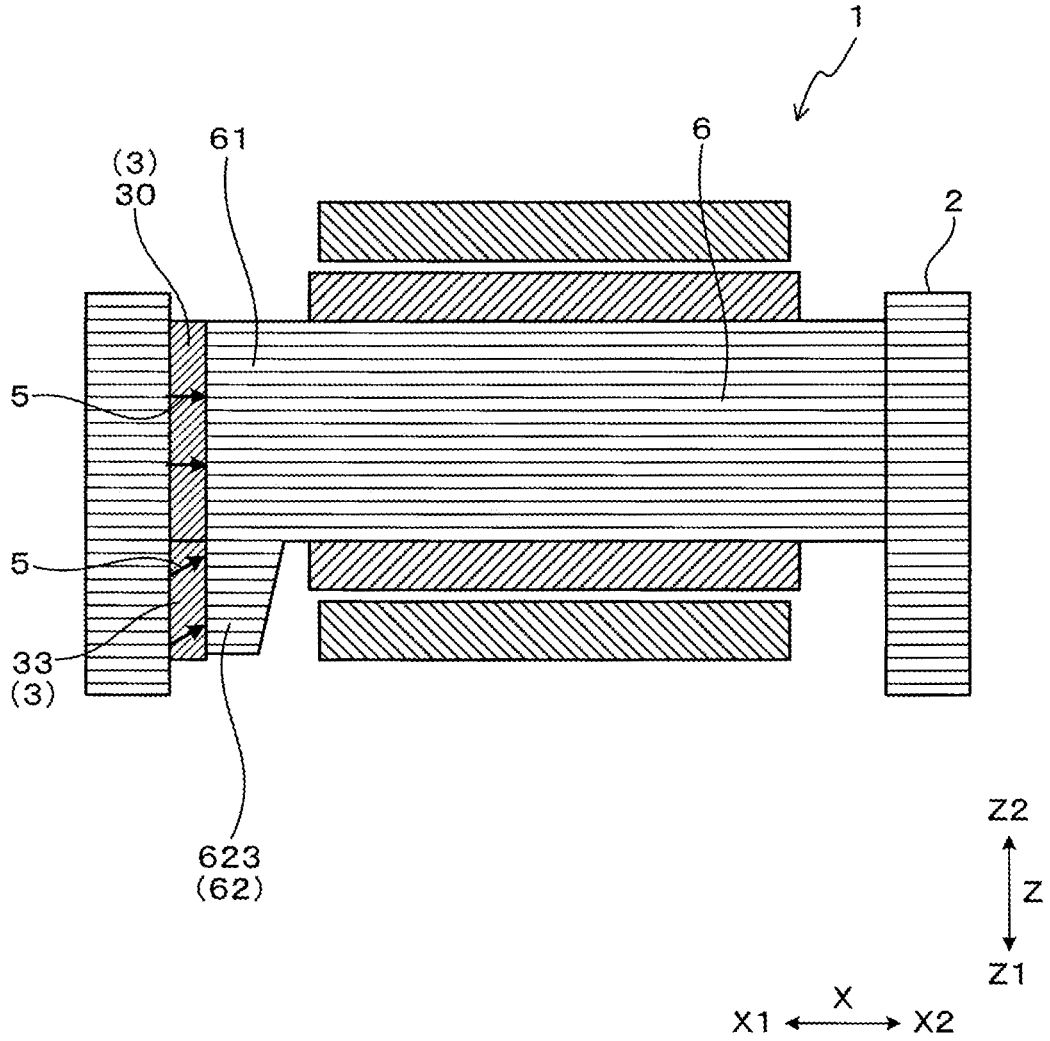
FIG. 15 is a sectional view, as taken along a direction perpendicular to a Y-direction of an ignition coil according to the fifth embodiment.
Figure 16:
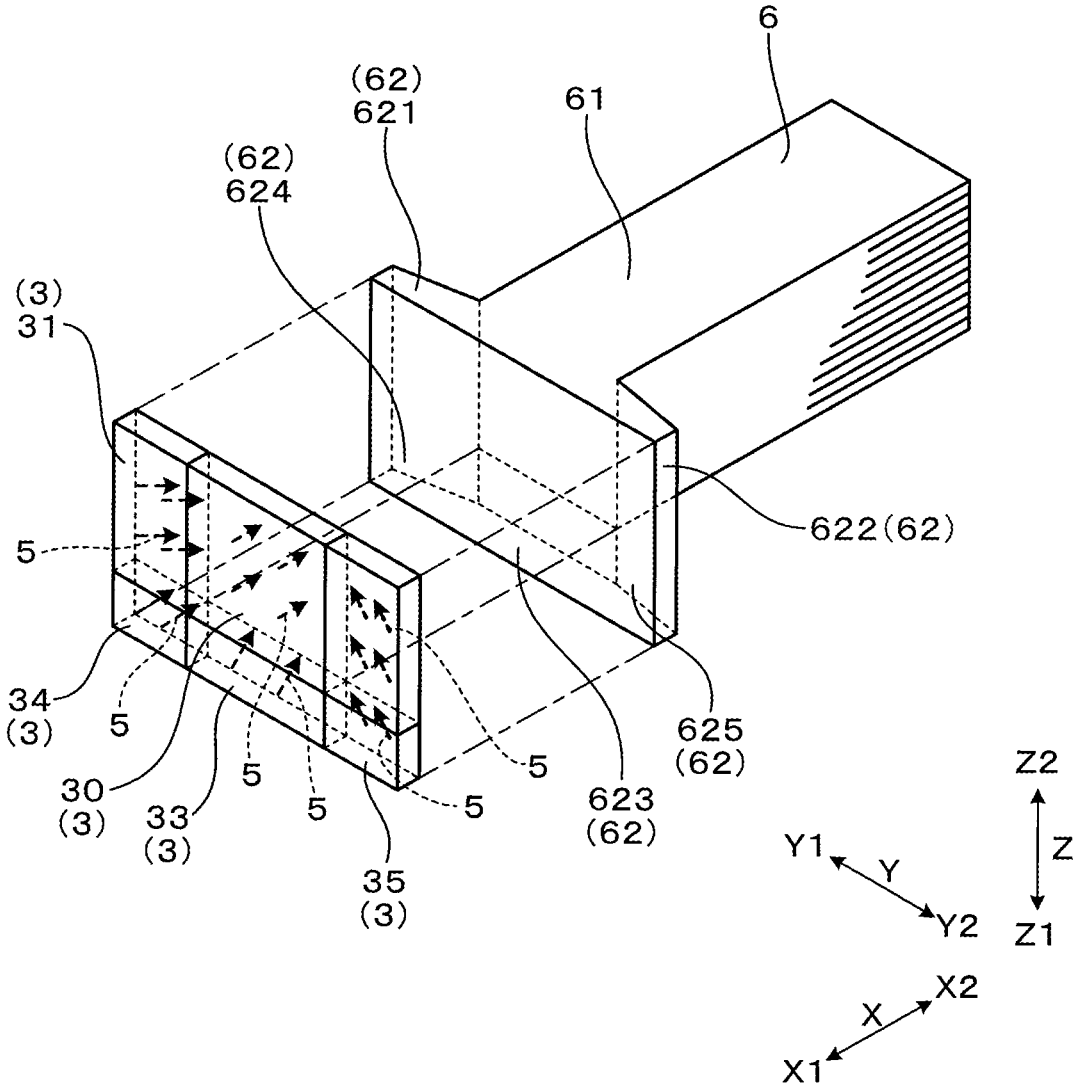
FIG. 16 is an exploded perspective view which illustrates a center core and magnets of an ignition coil in the fifth embodiment.

FIGS. 14 to 16 illustrate the ignition coil 1 according to the fifth embodiment which is different only in structure of the flanges 62 of the center core 6 and the magnets 3 from the fourth embodiment. Other arrangements are substantially identical with those in the fourth embodiment.

As viewed in the Z-direction, the flanges 62 extend outward from the body 61 of the center core 6 in opposite directions along the Y-direction. As viewed in the Y-direction, each of the flanges 62 also extends or protrudes outward from the body 61 in one of opposite directions (i.e., the direction Z1) along the Z-direction. A region further from the body 61 in the direction Z1 will also be referred as a side Z1. A region further from the body 61 in the direction Z2 will also be referred to as a side Z2.

For the sake of convenience in the following discussion, the flanges 62 are classified into five flanges: the first flange 621, the second flange 622, the third flange 623, the fourth flange 624, and the fifth flange 625. The first flange 621, as clearly illustrated in FIGS. 14 and 16, extends to the side Y1 from the front end of the body 61 which faces the first side wall 71 of the outer peripheral core 7. The second flange 622 extends to the side Y2 from the front end of the body 61. The third flange 623, as can be seen in FIGS. 15 and 16, extend from the front end of the body 61 to the side Z1. The fourth flange 624, as can be seen in FIG. 16, continues both to the first flange 621 and to the third flange 623. The fifth flange 625 continues both to the second flange 622 and to the third flange 623.

The first flange 621 and the fourth flange 624 are shaped to have transverse sections, as extending perpendicular to the Z-direction, which are identical in configuration with each other. The first flange 621 and the fourth flange 624 have front surfaces which are flat in a direction perpendicular to the Z-direction and lie flush with each other in the Z-direction. The first flange 621 and the fourth flange 624 have rear surfaces which extend in the Y-direction (i.e., the direction Y1) from the side surface of the body 61 of the center core 6 and are inclined obliquely in the forward direction X1.

The second flange 622 and the fifth flange 625 are shaped to have transverse sections, as extending perpendicular to the Z-direction, which are identical in configuration with each other. The second flange 622 and the fifth flange 625 have front surfaces which are flat in a direction perpendicular to the Z-direction and lie flush with each other in the Z-direction. The second flange 622 and the fifth flange 625 have rear surfaces which extend in the Y-direction (i.e., the direction Y2) from the side surface of the body 61 of the center core 6 and are inclined obliquely in the forward direction X1.

The third flange 623 is shaped to have front and rear surfaces which are flat and face in a direction (i.e., the X-direction) perpendicular to the Z-direction. The rear surface of the third flange 623 has ends which are opposed to each other in the Y-direction and continue or connect to the rear surfaces of the fourth flange 624 and the fifth flange 625. The front surfaces of the first flange 621 to the fifth flange 625 lie flush with the front surface of the body 61 of the center core 6. The front surfaces of the first flange 621 to the fifth flange 625 and the front surface of the body 61 define a rectangular flat surface of the front end 66 of the center core 6. The magnets 3 face or occupy the surface of the front end 66 of the center core 6.

The ignition coil 1 is equipped with six magnets 3. Specifically, the ignition coil 1 is equipped with the core body-facing magnet 30, the first magnet 31, the second magnet 32, the third magnet 33, the fourth magnet 34, and the fifth magnet 35.

The core body-facing magnet 30, as illustrated in FIGS. 14 to 16, faces the front surface of the body 61 of the center core 6. The whole of the core body-facing magnet 30 fully occupies or overlaps the whole of the front surface of the body 61 in the X-direction. The core body-facing magnet 30 has the magnetization vectors 5 oriented in the same direction. Specifically, the magnetization vectors 5 in the core body-facing magnet 30 extend in the X-direction. An orientation from an initial point to an end point of each of the magnetization vectors 5 is directed from the front side X1 to the rear side X2.

The first magnet 31, as illustrated in FIGS. 14 and 16, faces the front surface of the first flange 621. The first magnet 31 is laid to fully occupy or overlap the whole of the front surface of the first flange 621 in the X-direction. The first magnet 31 has the magnetization vectors 5 oriented in the same direction. Specifically, an orientation from an initial point to an end point of each of the magnetization vectors 5 in the first magnet 31 is directed in the rearward direction X2 and obliquely in the direction Y2.

The second magnet 32 faces the front surface of the second flange 622. Specifically, the second magnet 32 is laid to occupy or fully overlap the whole of the front surface of the second flange 622 in the X-direction. The second magnet 32 has the magnetization vectors 5 oriented in the same direction. Specifically, an orientation from an initial point to an end point of each of the magnetization vectors 5 in the second magnet 32 is directed in the rearward direction X2 and obliquely in the direction Y1.

The third magnet 33, as illustrated in FIGS. 15 and 16, faces the front surface of the third flange 623 in the X-direction. Specifically, the third magnet 33 is laid to occupy or fully overlap the whole of the front surface of the third flange 623 in the X-direction. The third magnet 33 has the magnetization vectors 5 oriented in the same direction. Specifically, an orientation from an initial point to an end point of each of the magnetization vectors 5 in the third magnet 33 is directed in the rearward direction X2 and obliquely in the direction Z2 which is opposite the direction Z1 along the X-direction.

The fourth magnet 34, as can be seen in FIG. 16, faces the front surface of the fourth flange 624 in the X-direction. Specifically, the fourth magnet 34 is laid to occupy or fully overlap the whole of the front surface of the fourth flange 624 in the X-direction. The fourth magnet 34 has the magnetization vectors 5 oriented in the same direction. Specifically, an orientation from an initial point to an end point of each of the magnetization vectors 5 in the fourth magnet 34 is directed in the rearward direction X2 and obliquely both in the direction Y2 and in the direction Z2.

The fifth magnet 35 faces the front surface of the fifth flange 625 in the X-direction. Specifically, the fifth magnet 35 is laid to occupy or fully overlap the whole of the front surface of the fifth flange 625 in the X-direction. The fifth magnet 35 has the magnetization vectors 5 oriented in the same direction. Specifically, an orientation from an initial point to an end point of each of the magnetization vectors 5 is directed in the rearward direction X2 and obliquely both in the direction Y1 and in the direction Z2.

As apparent from the above discussion, the magnetization vectors 5 in each of the first to fifth magnets 31 to 35 extend in the rearward direction X2 and obliquely toward the body 61 (e.g., the longitudinal center line of the body 61) of the center core 6.

Other arrangements of the ignition coil 1 are identical with those in the fourth embodiment.

As apparent from the above discussion, the first to fifth magnets 31 to 35 which face the flanges 62 in the X-direction have the magnetization vectors 5 which are oriented in the rearward direction X2 and obliquely toward the longitudinal center line (i.e., the axis) of the center core 6. The magnetization vectors 5 in the core body-facing magnet 30 which faces the body 61 of the center core 6 in the X-direction extend substantially parallel to each other in the X-direction. The magnetization vectors 5 in the first to fifth magnets 31 to 35 and the core body-facing magnet 30 are, therefore, collected to a given portion of the body 61 of the center core 6 which is defined around the longitudinal center line of the center core 6. Such orientation of the magnetization vectors 5, like the fourth embodiment, facilitates an increase in a change in amount of magnetic flux upon de-energization of the primary coil 11.

The above structure of the ignition coil 1 according to this embodiment also offers substantially the same other beneficial advantages as those in the fourth embodiments.

Sixth Embodiment

Figure 17:
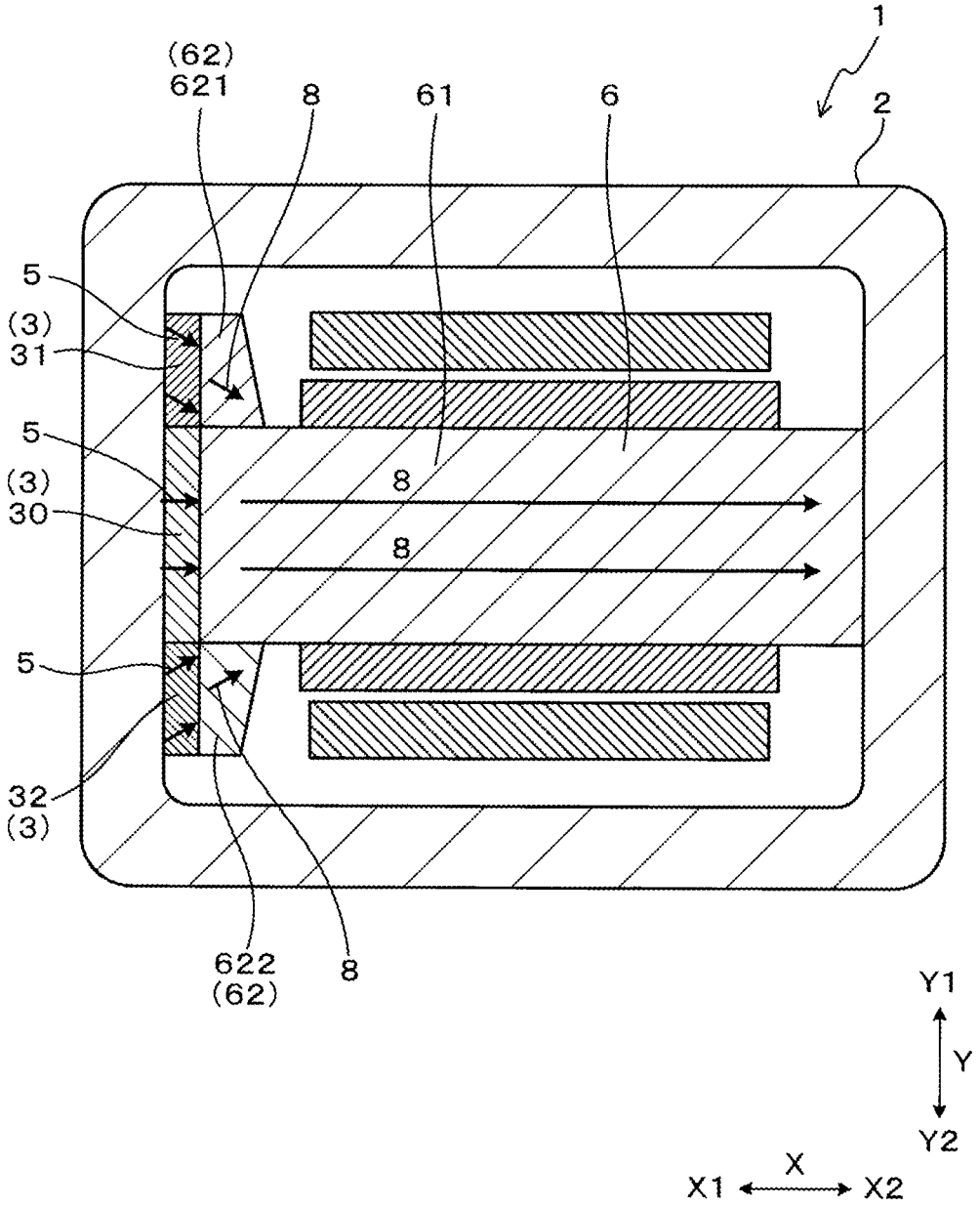
FIG. 17 is a sectional view, as taken along a direction perpendicular to a Z-direction of an ignition coil according to the sixth embodiment.
Figure 18:
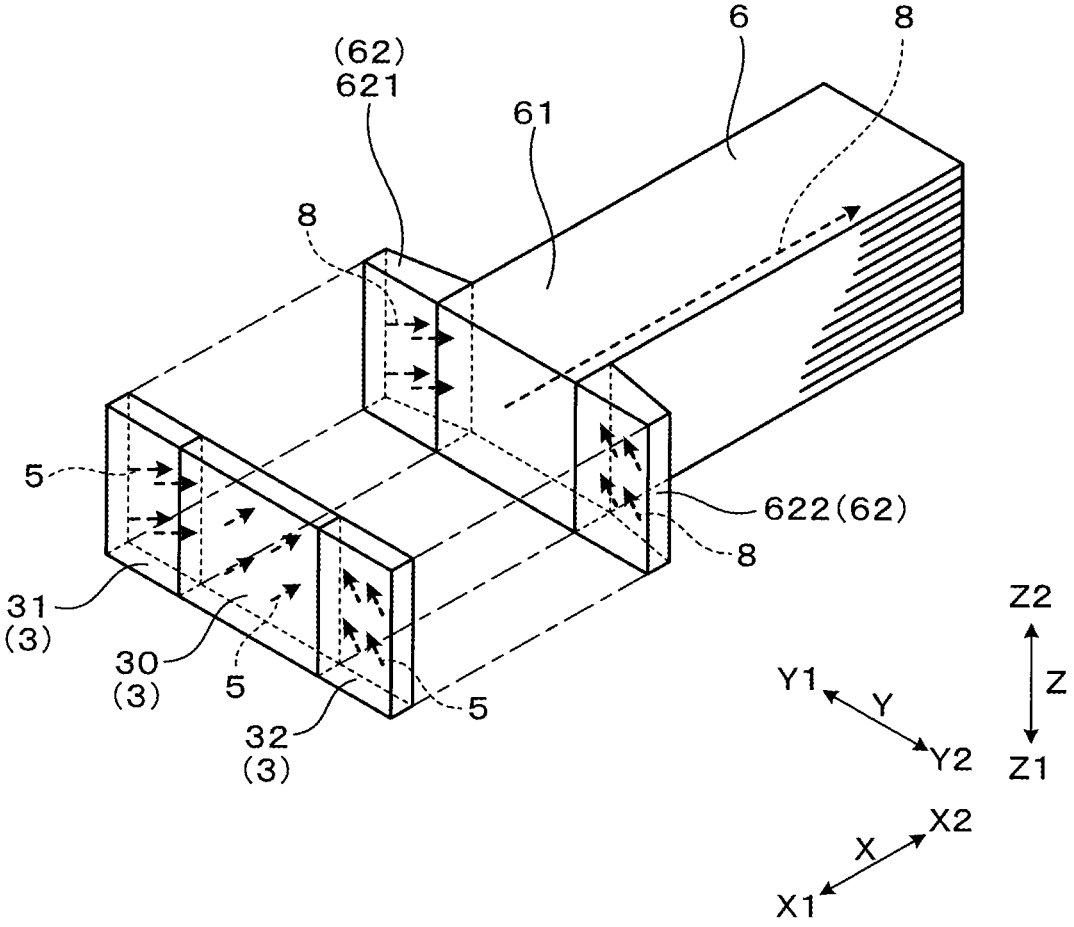
FIG. 18 is an exploded perspective view which illustrates a center core and magnets of an ignition coil in the sixth embodiment.
Figure 19:
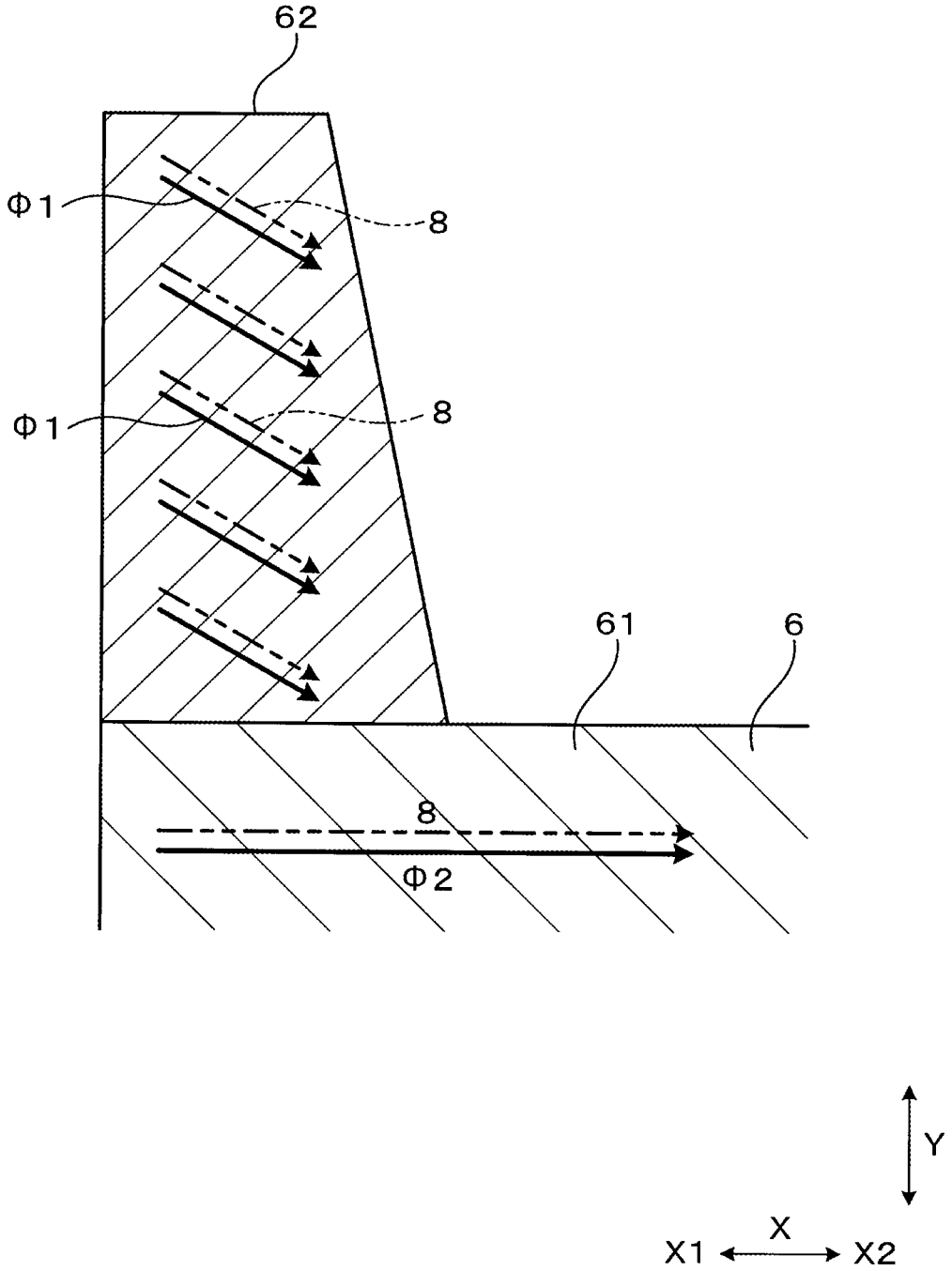
FIG. 19 is a partially sectional view which illustrates a region around a flange of a center core of the ignition coil of FIG. 17 and demonstrates orientation of magnetic fluxes and easy directions of magnetization in the center core.

FIGS. 17 to 19 illustrate the ignition coil 1 according to the sixth embodiment which is different only in structure of the flanges 62 of the center core 6 from the fourth embodiment. Other arrangements are substantially identical with those in the fourth embodiment.

The center core 6 includes the body 61, the first flange 621, and the second flange 622 which are, as illustrated in FIGS. 17 and 18, discrete from each other. Specifically, magnetic steel plates making the body 61, the first flange 621, and the second flange 622 are discrete from each other.

The body 61 is designed to have magnetic domains whose easy directions 8 of magnetization are oriented in the same direction. The easy direction 8 of magnetization, as referred to herein, is a direction in which the body 61 is easy to magnetize. Specifically, the body 61 has magnetic domains whose easy directions 8 of magnetization are parallel to the magnetization vectors 5 in portions or magnetic domains of the core body-facing magnet 30 and oriented in the same direction as that of the magnetization vectors 5 in magnetic domains of the body-facing magnet 30. In other words, the easy directions 8 of magnetization of the body 61 are oriented in the X-direction (i.e., the rearward direction X2).

The first flange 621 has magnetic domains whose easy directions 8 of magnetization are oriented in the same direction. Specifically, the easy directions 8 of magnetization in the first flange 621 are parallel to the magnetization vectors 5 in magnetic domains of the first magnet 31 and oriented in the same direction as that in which the magnetization vectors 5 in the first magnet 31 are oriented. Specifically, the easy directions 8 of magnetization of the first flange 621 are oriented in the rearward direction X2 and obliquely in the direction Y2 (i.e., toward the longitudinal center line of the body 61 of the center core 6).

The second flange 622 has magnetic domains whose easy directions 8 of magnetization are oriented in the same direction. Specifically, the easy directions 8 of magnetization in the second flange 622 are parallel to the magnetization vectors 5 in magnetic domains of the second magnet 32 and oriented in the same direction as that the magnetization vectors 5 in the second magnet 32 are oriented. Specifically, the easy directions 8 of magnetization of the second flange 622 are oriented in the rearward direction X2 and obliquely in the direction Y1 (i.e., toward the longitudinal center line of the body 61 of the center core 6).

As apparent from the above discussion, the easy directions 8 of magnetization in magnetic domains of the first flange 621 and the second flange 622 are oriented in the rearward direction X2 and obliquely toward the body 61 of the center core 6.

Other arrangements of the ignition coil 1 are identical with those in the fourth embodiment.

The easy directions 8 of magnetization in the flange 62 (i.e., the first flange 621 and the second flange 622) are, as described above, oriented away from the magnets 3 in the rearward direction X2 and obliquely in a direction perpendicular to the X-direction toward the body 61 of the center core 6, in other words, inclined at a given angle (excluding zero) relative to the longitudinal center line (i.e., the axis) of the body 61, thereby facilitating an increase in a change in amount of magnetic flux upon de-energization of the primary coil 11. This will also be described below.

When supply of electrical power to the primary coil 11 is cut, it will cause magnetic fluxes φ1 to be, as demonstrated in FIG. 19, generated in each of the flanges 62. The magnetic fluxes φ1 flow along the easy directions 8 of magnetization in the flange 62, in other words, are oriented in the rearward direction X2 and obliquely toward the body 61 of the center core 6, thereby collecting flows of the magnetic fluxes φ1 in the body 61 of the center core 6. This results in an increased change in amount of magnetic flux in the whole of the core 2 upon de-energization of the primary coil 11.

Additionally, when the primary coil 11 is de-energized, it will cause magnetic fluxes φ2 to be, as demonstrated in FIG. 19, generated in the body 61 of the center core 6. The magnetic fluxes φ2 flow in the rearward direction X2 along the easy directions 8 of magnetization in the body 61 (i.e., along a magnetic path in the body 61). This also results in an increase in amount of magnetic flux in the center core 6, i.e., the whole of the core 2, thereby increasing a change in amount of magnetic flux in the core 2 upon de-energization of the primary coil 11.

The easy directions 8 of magnetization in each of the flanges 62 are, as described above, oriented in the same direction as that in which the magnetization vectors 5 in an adjacent one of the magnets 3 are oriented. The easy directions 8 of magnetization in the body 61 are oriented in the same direction as that in which the magnetization vectors 5 in the core body-facing magnet 30 are oriented. This also facilitates an increase in amount of magnetic flux appearing in the whole of the center core 6 upon de-energization of the primary coil 11, thereby increasing a change in amount of magnetic flux in the core 2 upon de-energization of the primary coil 11.

The structure of the ignition coil 1 in this embodiment offers substantially the same other beneficial advantages as in the fourth embodiment.

Seventh Embodiment

Figure 20:
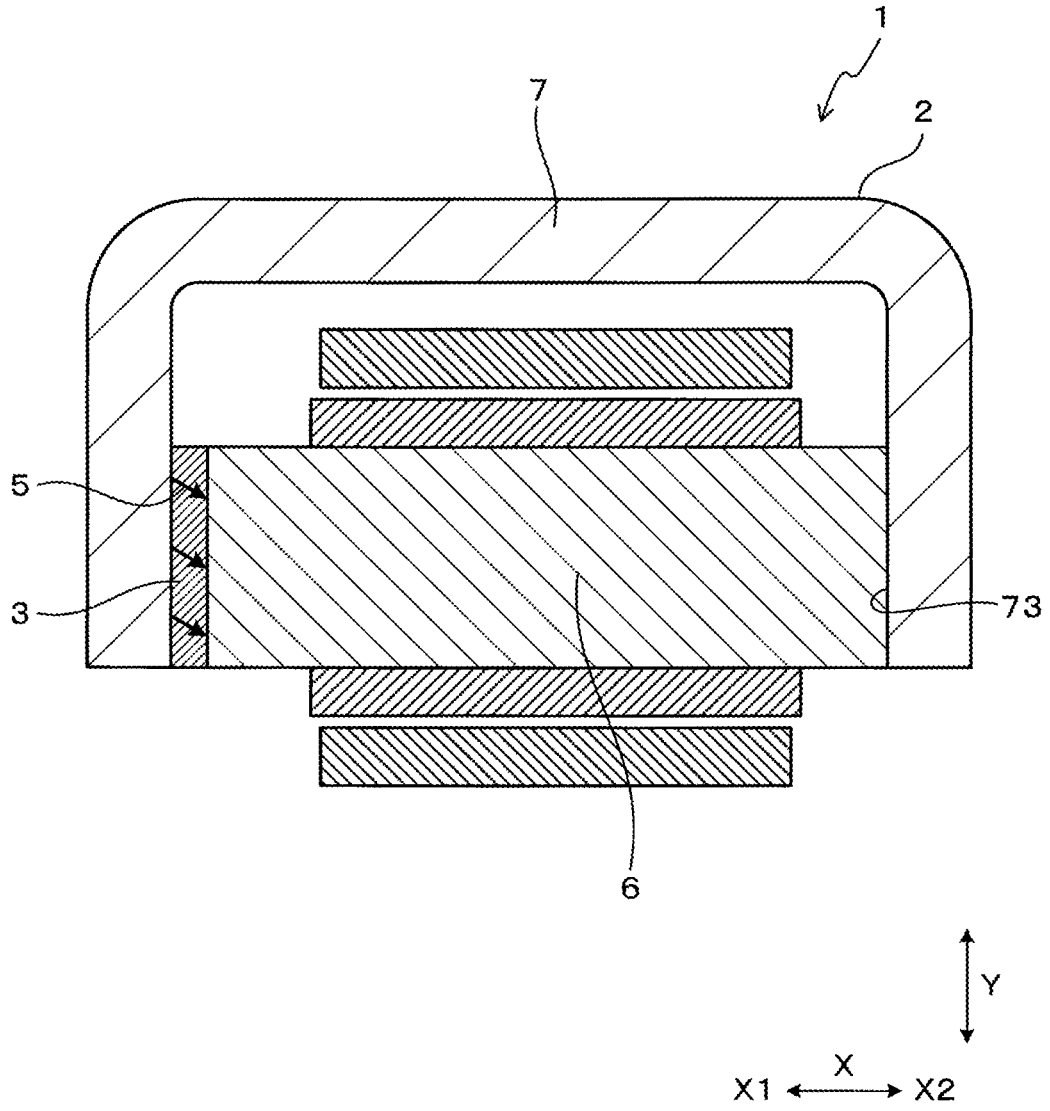
FIG. 20 is a sectional view, as taken along a direction perpendicular to a Z-direction of an ignition coil according to the seventh embodiment.

FIG. 20 illustrates the ignition coil 1 according to the seventh embodiment which is different in structure of the outer peripheral core 7 from the first embodiment.

The outer peripheral core 7 is of a C- or U-shape, as viewed in the Z-direction and opens in one of opposite directions along the Y-direction. The outer peripheral core 7 has the open end portion 73 in which the center core 6 and the magnet 3 are disposed.

Other arrangements of the ignition coil 1 are identical with those in the first embodiment.

The above structure of the ignition coil 1 offers substantially the same beneficial advantages as in the first embodiment.

Eighth Embodiment

Figure 21:
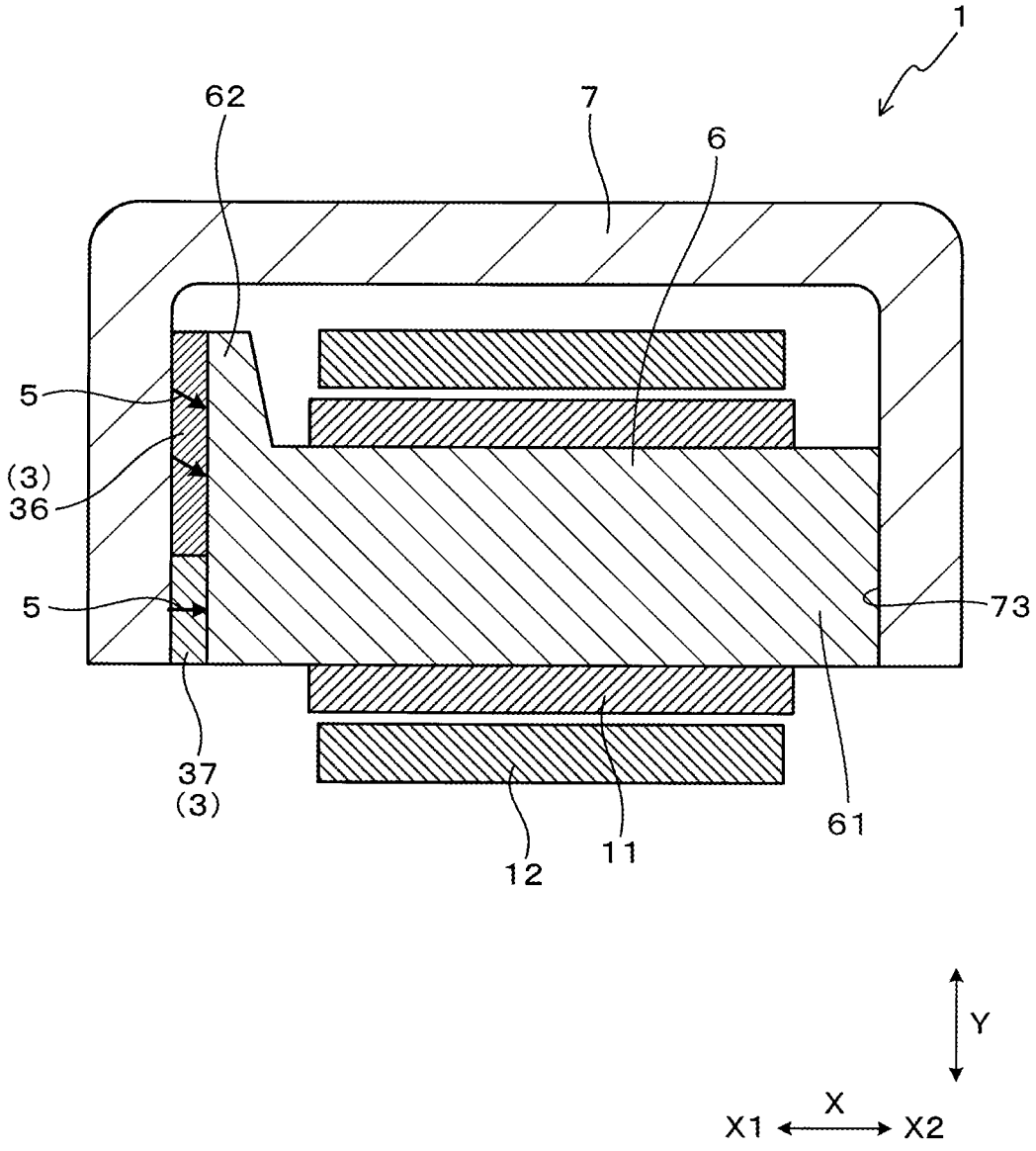
FIG. 21 is a sectional view, as taken along a direction perpendicular to a Z-direction of an ignition coil according to the eighth embodiment.

FIG. 21 illustrates the ignition coil 1 according to the eighth embodiment which is different in structure of the center core 6 and the magnets 3 from the seventh embodiment.

The center core 6 includes the body 61 and the flange 62. The flange 62 extends from the body 61 in a direction away from the opening of the outer peripheral core 7 along the Y-direction.

The magnets 3 include two magnets: the sixth magnet 36 and the seventh magnet 37. The sixth magnet 36 is laid to at least partially face the flange 62. The seventh magnet 37 is aligned with the sixth magnet 36 in the Y-direction and fully faces the body 61 of the center core 6.

The sixth magnet 36 has an outer end and an inner end opposed to the outer end in the Y-direction. The outer end lies flush with an outer end (i.e., a protruding end) of the flange 62 in the Y-direction. The inner end of the sixth magnet 36 is aligned with the length of the body 61 in the X-direction. The sixth magnet 36 has magnetic domains whose magnetization vectors 5 are oriented in the same direction. Specifically, an initial point to an end point of each of the magnetization vectors 5 in the sixth magnet 36 is directed in the rearward direction X2 and obliquely in the Y-direction, i.e., toward the axis of the body 61 of the center core 6.

The seventh magnet 37 has an inner end and an outer end opposed to the inner end in the Y-direction. The inner end of the seventh magnet 37 abuts the inner end of the sixth magnet 36. The outer end of the seventh magnet 37 which is further from the sixth magnet 36 is laid flush with an outer side surface of the body 61 which faces away from the flange 62, in other words, is exposed outside the outer peripheral core 7. The seventh magnet 37 has magnetic domains whose magnetization vectors 5 are oriented in the same direction. Specifically, an orientation from an initial point to an end point of each of the magnetization vectors 5 in the seventh magnet 37 is oriented in the rearward direction X2.

Other arrangements of the ignition coil 1 are identical with those in the seventh embodiment.

The above structure of the ignition coil 1 offers substantially the same beneficial advantages as in the fourth or seventh embodiment.

Ninth Embodiment

Figure 22:
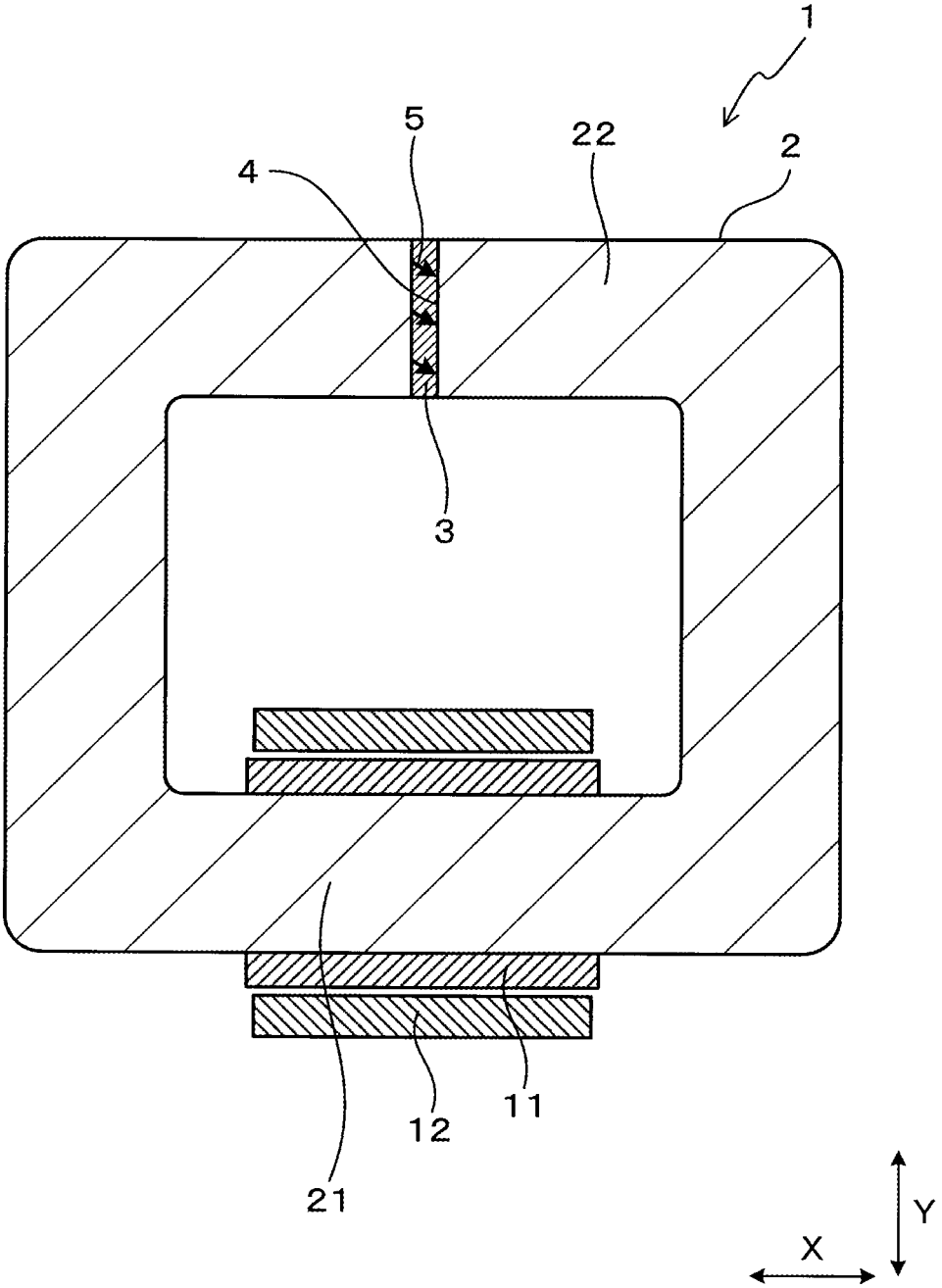
FIG. 22 is a sectional view, as taken along a direction perpendicular to a Z-direction of an ignition coil according to the ninth embodiment.

FIG. 22 illustrates the ignition coil 1 according to the ninth embodiment which is different in structure of the core 2 from the first embodiment.

The core 2 is of a closed hollow rectangular shape, as viewed in the Z-direction, and has four sides. One of the four sides of the core 2 is disposed inside the primary coil 11 and the secondary coil 12 and will also be referred to as the in-coil side 21. One of the four sides of the core 2 which faces the in-coil side 21 in the Y-direction will also be referred to as the coil-facing side 22. The coil-facing side 22 has the gap 4 formed in a portion of a length thereof. The magnet 3 is disposed in the gap 4. The magnet 3 has magnetic domains whose magnetization vectors 5 are oriented obliquely in the gap direction of the coil-facing side 22 (i.e., the X-direction), in other words, inclined at a given angle (excluding zero) relative to the length of the coil-facing side 2.

Other arrangements of the ignition coil 1 are identical with those in the first embodiment.

The above structure of the ignition coil 1 offers substantially the same beneficial advantages as in the first embodiment.

Tenth Embodiment

Figure 23:
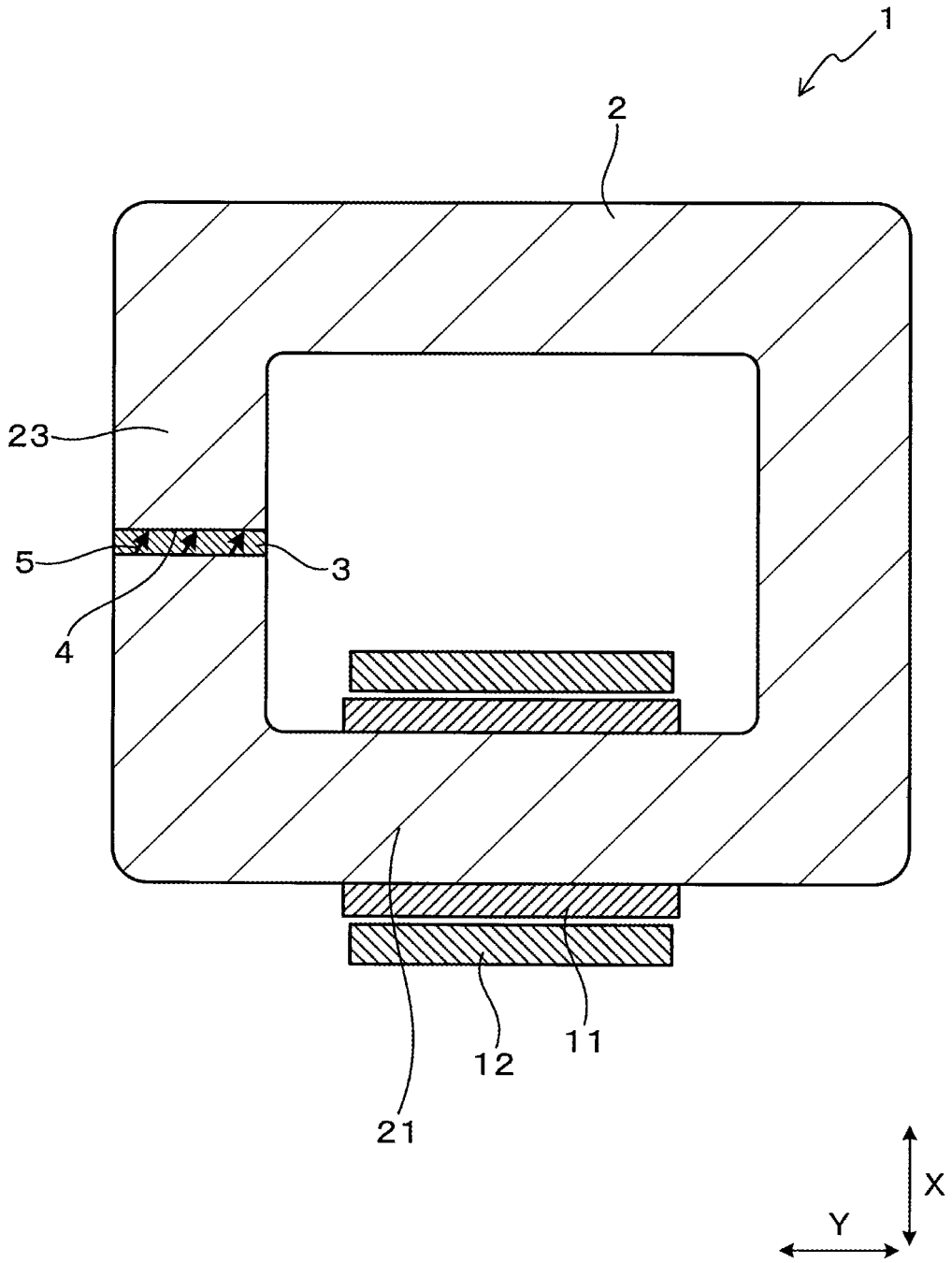
FIG. 23 is a sectional view, as taken along a direction perpendicular to a Z-direction of an ignition coil according to the tenth embodiment.

FIG. 23 illustrates the ignition coil 1 according to the tenth embodiment which is different in location of the gap 4 from the ninth embodiment.

The core 2 is, like in the ninth embodiment, of a closed hollow rectangular shape and has the side 23 located adjacent the in-coil side 21. The side 23 has the gap 4 formed in a portion of a length thereof extending in the X-direction. The side 23 has the length extending in the Y-direction that is an axial direction of windings of the primary coil 11 and the secondary coil 12 and perpendicular to the X-direction. In this embodiment, the gap direction is the Y-direction. The magnet 3 is disposed in the gap 4. The magnet 3 has magnetic domains whose magnetization vectors 5 are inclined at a given angle (excluding zero) relative to the length of the side 23 (i.e., X-the direction).

Other arrangements of the ignition coil 1 are identical with those in the ninth embodiment.

The above structure of the ignition coil 1 offers substantially the same beneficial advantages as in the ninth embodiment.

Experiment 1

We performed simulations regarding the secondary energy in the ignition coil 1 having the structure in the first embodiment as a function of speed of an internal combustion engine for different values of the angle θ of inclination of the magnetization vectors 5 in the magnet 3 relative to the gap direction.

We prepared four samples of the ignition coil 1 which are different in value of the angle θ from each other and will be referred to below as samples A1 to A3 and a comparative sample A0). The sample A1 has an angle θ of 10°. The sample A2 has an angle θ of 20°. The sample A3 has an angle θ of 30°. The comparative sample A0 has an angle θ of 0°, that is, has the magnetization vectors 5 in the magnet 3 which extend parallel in the gap direction. We evaluated the secondary energy in each of the samples A0 to A3 at engine speeds of 3,200 to 7,000 rpm. Results of the simulations are shown in a graph of FIG. 24.

Figure 24:
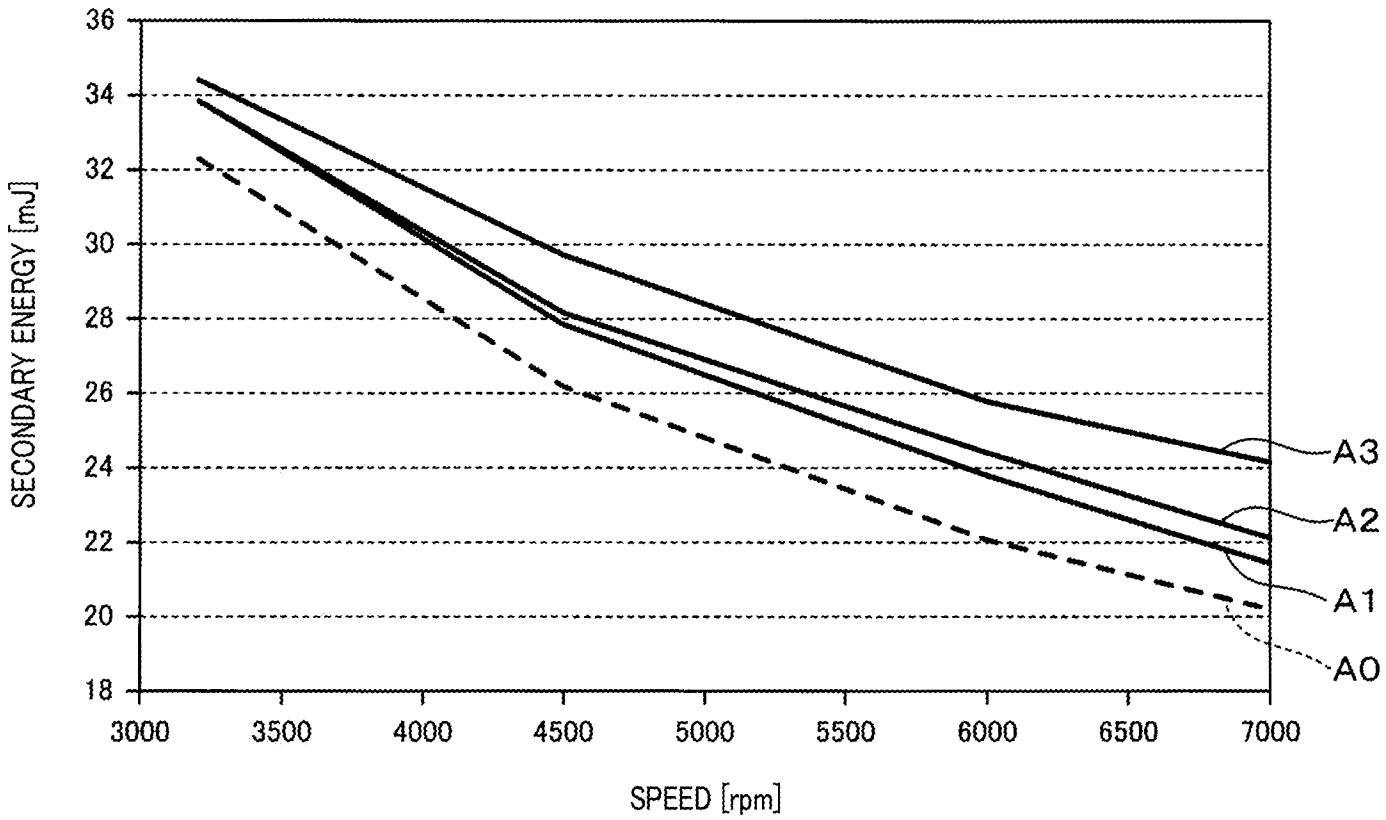
FIG. 24 is a graph which represents secondary energy produced in test samples in a first experimental example.

The graph in FIG. 24 shows that the samples A1 to A3 in which the angle θ is larger than 0° are higher in secondary energy outputted to the secondary coil 12 at any speed of the internal combustion engine, and thus that it is possible for the samples A1 to A3 to produce an enhanced degree of the secondary energy as compared with the case where the angle θ is 0°.

Experiment 2

We made simulations about the secondary energy in the ignition coil 1 having the structure in the first to sixth embodiments in the same way as in the experiment 1. We prepared five types of samples B1 to B5 and a comparative sample B0. The sample B1 has the same structure as that of the ignition coil 1 in the second embodiment. The sample B2 has the same structure as that of the ignition coil 1 in the third embodiment. The sample B3 has the same structure as that of the ignition coil 1 in the fourth embodiment. The sample B4 has the same structure as that of the ignition coil 1 in the fifth embodiment. The sample B5 has the same structure as that of the ignition coil 1 in the sixth embodiment. The comparative sample B0 basically has the same structure as that of the ignition coil 1 in the second embodiment, but has the magnetization vectors 5 in magnetic domains of the magnet 3 which are oriented in parallel to the gap direction. We evaluated the secondary energy produced in each of the samples B1 to B0 at speeds of 3,200 to 7,000 rpm. Results of the experiments are shown in a graph of FIG. 25.

Figure 25:
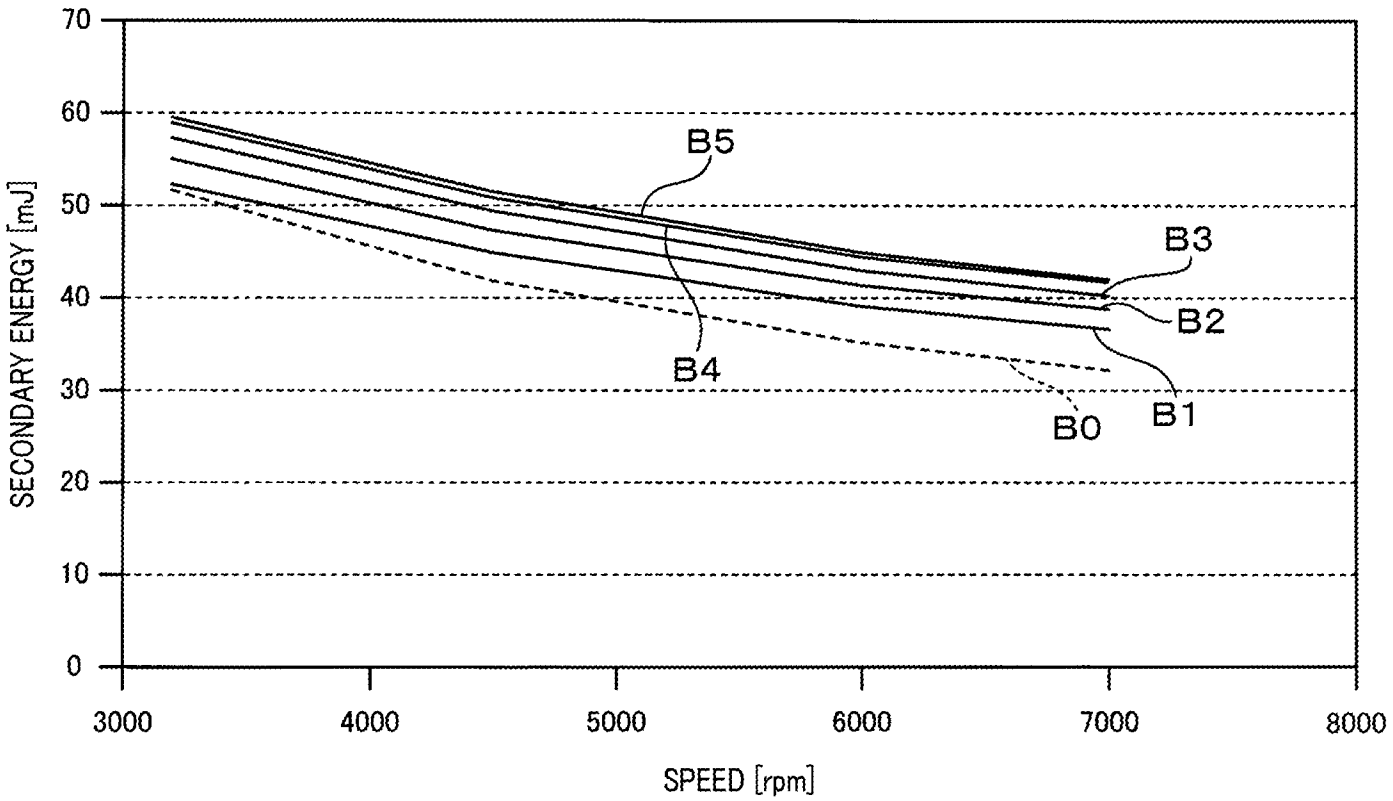
FIG. 25 is a graph which represents secondary energy produced in test samples in a second experimental example.
Figure 26:
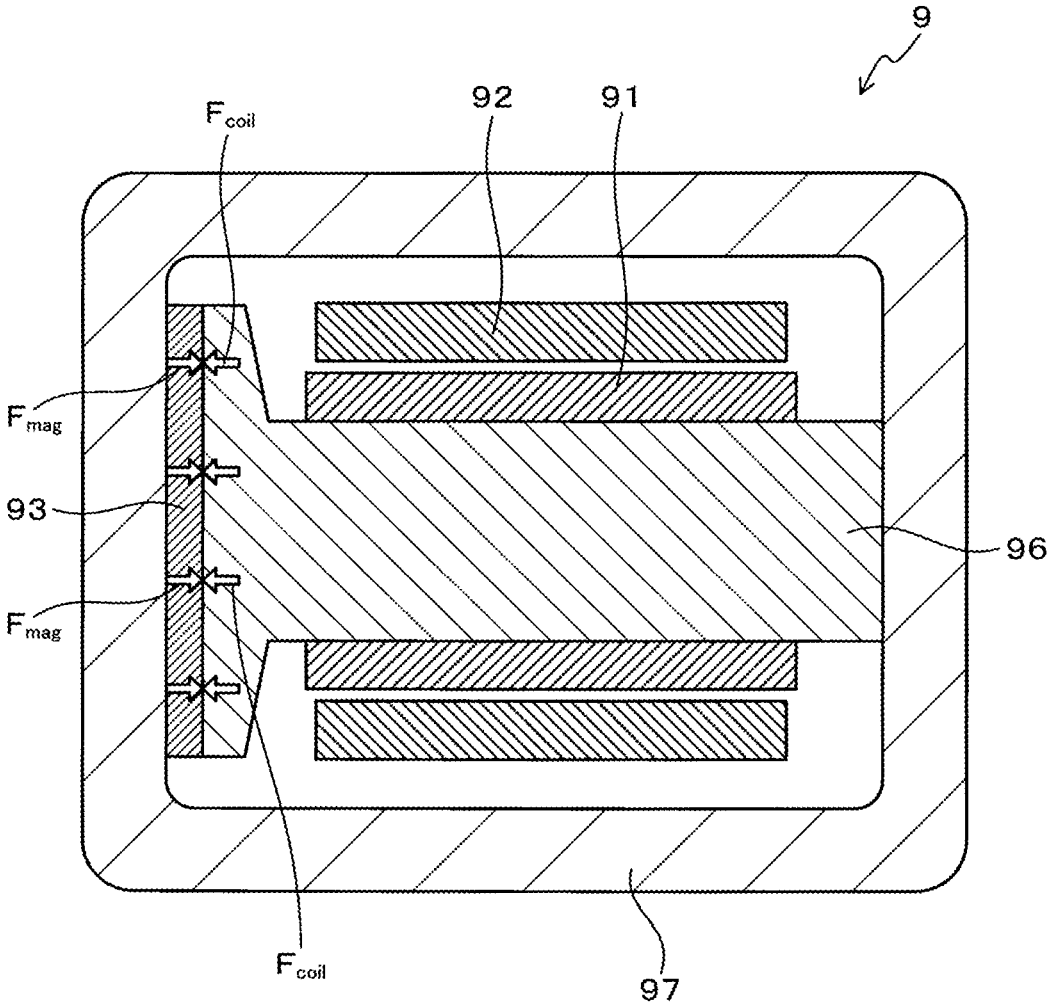
FIG.26 PRIOR ART
FIG. 26 is a sectional view which illustrates a conventional ignition coil.
Figure 27:
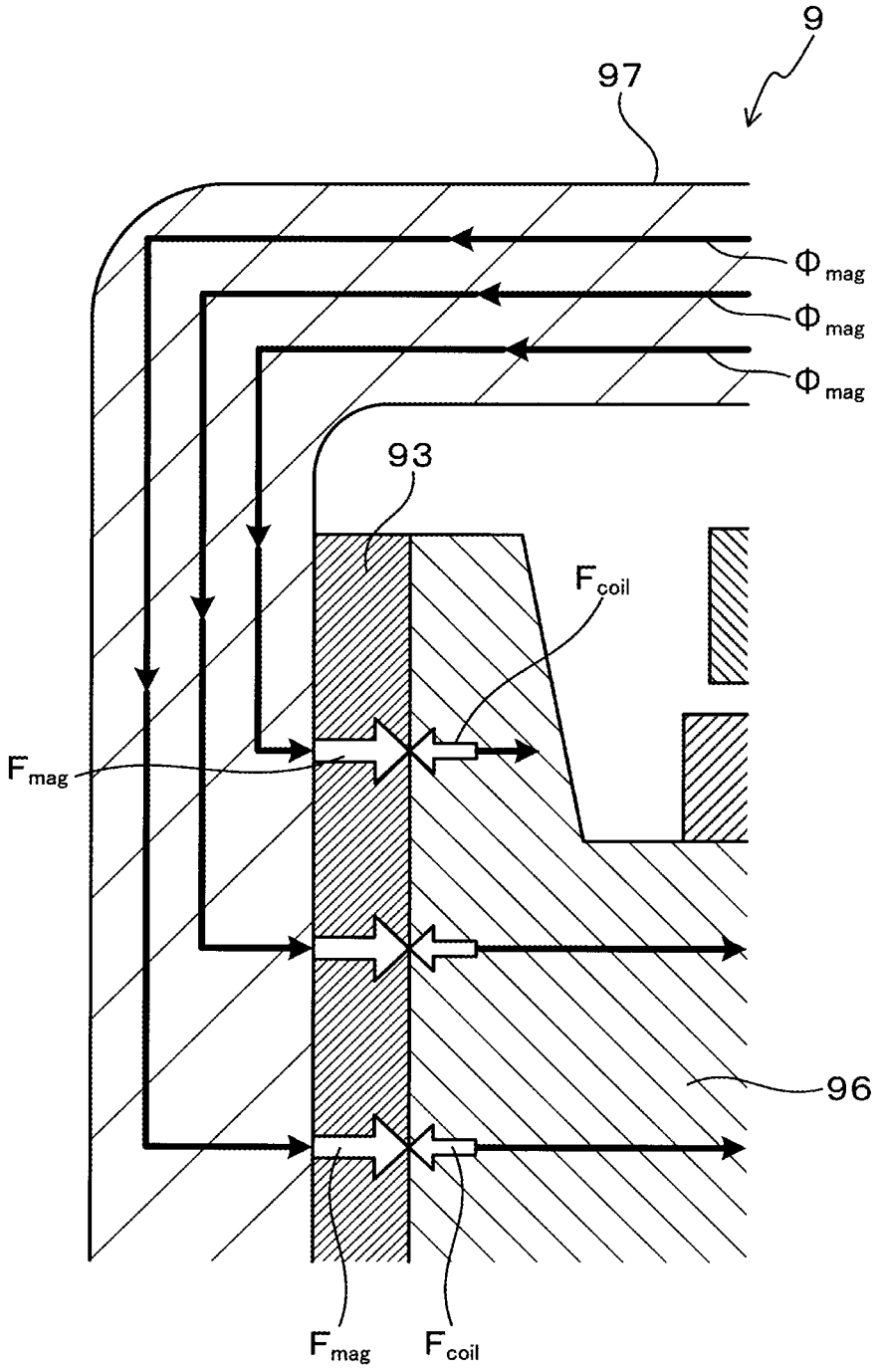
FIG.27 PRIOR ART
FIG. 27 is a partially sectional view of the ignition coil of FIG. 26 and demonstrates magnetic flux produced upon energization of a primary coil.
Figure 28:
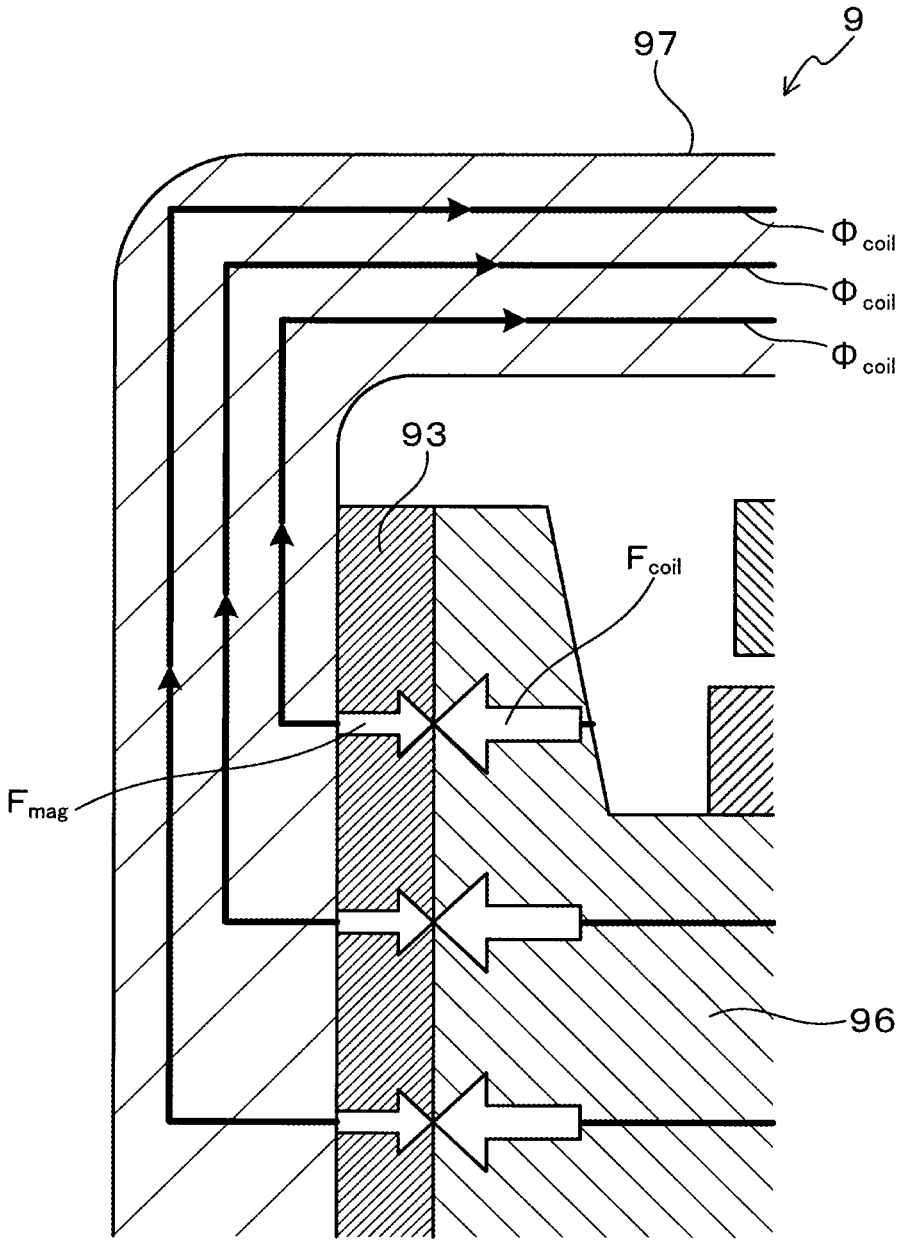
FIG.28 PRIOR ART
FIG. 28 is a partially sectional view of the ignition coil of FIG. 26 and demonstrates magnetic flux produced t1*ms* after energization of a primary coil.
Figure 29:
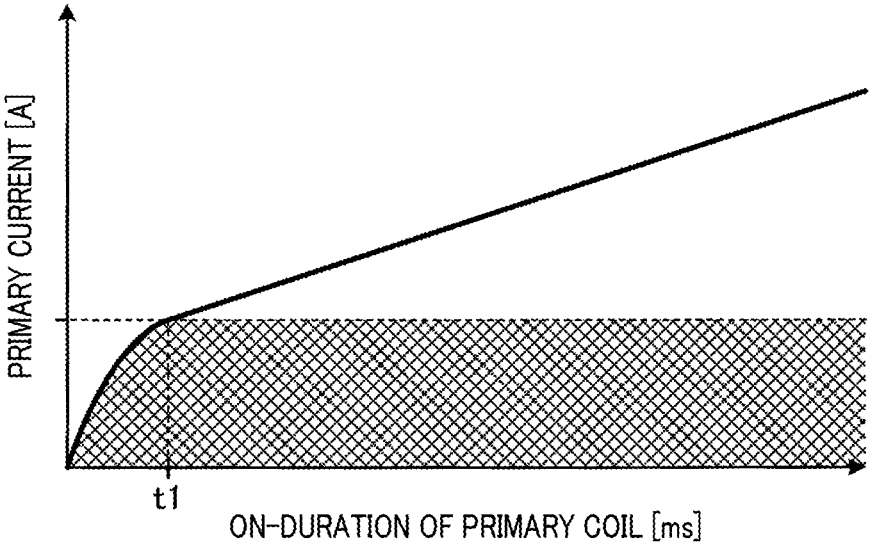
FIG.29 PRIOR ART
FIG. 29 is a graph which represents a relation between on-duration of a primary coil and primary current produced by the primary coil in a conventional ignition coil.

The graph in FIG. 25 shows that the samples B1 to B5 (i.e., the second to sixth embodiments) are higher in secondary energy outputted to the secondary coil 12 than the comparative sample B0 in which the magnetization vectors 5 in the magnet 3 are parallel to the gap direction.

The graph also shows that the sample B5 (i.e., the sixth embodiment) is higher in the secondary energy than any other samples B1 to B4, and B0 at any speeds, and thus that the secondary energy is enhanced by orienting the easy direction 8 of magnetization in each of the flanges 62 in the same direction as that of the magnetization vectors 5 in an adjacent one of the magnets 3.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An ignition coil comprising:

a primary coil and a secondary coil which are magnetically coupled with each other;

a core which defines a closed magnetic circuit, wherein magnetic flux produced by energization of the primary coil flows in the magnetic circuit, the core has a gap formed therein, and the magnetic circuit extends through the gap; and a magnet which is disposed in the gap of the core, wherein the magnet has magnetization vectors at least a portion of which is inclined relative to a gap direction.

2. The ignition coil as set forth in claim 1, wherein the core includes a center core and an outer peripheral core, the center core being disposed inside inner peripheries the primary and secondary coils, the outer peripheral core being disposed outside outer peripheries of the primary and secondary coils, the center core includes a body and a flange, the center core having a length with a first end and a second end which are opposed to each other in the gap direction that is a lengthwise direction of the center core, the flange extending from the first end of the center core in a direction perpendicular to the gap direction, the magnet is disposed to face the first end of the center core in the gap direction, and the magnet includes at least a first magnet and a second magnet at least one of which faces the flange in the gap direction and which has the magnetization vectors at least a portion of which is inclined relative to the gap direction and obliquely in a direction opposite a direction in which the flange protrudes from the first end of the center core.

3. The ignition coil as set forth in claim 2, wherein one of the first and second magnets faces the body of the center core in the gap direction and has the magnetization vectors at least a portion of which is oriented substantially parallel to the gap direction.

4. The ignition coil as set forth in claim 2, wherein the flange has easy directions of magnetization at least a portion of which is oriented away from the magnet and inclined obliquely toward a longitudinal center of the body of the center core.

5. The ignition coil as set forth in claim 1, wherein the core has surfaces which face each other through the gap, and wherein the gap direction is a direction in which the surfaces of the core face each other through the gap.

6. The ignition coil as set forth in claim 1, wherein at least a portion of the magnetization vectors is inclined relative to the gap direction to thereby minimize an energy loss when a primary energy is transformed into a secondary energy.

7. The ignition coil as set forth in claim 1, wherein an inclination of the magnetization vectors at an angle relative to the gap direction causes a magnet-magnetomotive force produced by the magnet to have a component that is opposed in the gap direction to a coil-magnetomotive force of the magnetic flux produced by energization of the primary coil; and the coil-magnetomotive force exceeds the component of the magnet-magnetomotive force.

8. The ignition coil as set forth in claim 1, wherein the magnet includes at least a first magnet and a second magnet; and the first magnet and the second magnet contact each other at a boundary between the first magnet and the second magnet.

9. The ignition coil as set forth in claim 1, wherein:

the core includes a center core and an outer peripheral core;

the magnet includes at least a first magnet and a second magnet; and a boundary contacting and arranged between the first magnet and the second magnet is aligned with a longitudinal center axis of the center core.

10. The ignition coil as set forth in claim 1, wherein:

the magnet includes at least a first magnet and a second magnet; and the magnetization vectors in the second magnet are oriented in a direction opposite to that in which the magnetization vectors in the first magnet are oriented.

11. The ignition coil as set forth in claim 1, wherein:

the core includes a center core and an outer peripheral core;

the magnet includes at least a first magnet and a second magnet; and the magnetization vectors of each of the first magnet and the second magnet are orient obliquely radially inwardly relative to a longitudinal center line of the center core.

* * * * *